US010850514B2

(12) United States Patent
Kakiuchi et al.

(10) Patent No.: US 10,850,514 B2
(45) Date of Patent: Dec. 1, 2020

(54) LIQUID EJECTING HEAD AND METHOD FOR MANUFACTURING LIQUID EJECTING HEAD

(71) Applicant: BROTHER KOGYO KABUSHIKI KAISHA, Nagoya (JP)

(72) Inventors: Toru Kakiuchi, Aichi-ken (JP); Yasuo Kato, Aichi-ken (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 8 days.

(21) Appl. No.: 16/192,023

(22) Filed: Nov. 15, 2018

(65) Prior Publication Data

US 2019/0291430 A1 Sep. 26, 2019

(30) Foreign Application Priority Data

Mar. 20, 2018 (JP) ..... 2018-052110

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2002/14241* (2013.01); *B41J 2002/14419* (2013.01); *B41J 2002/14491* (2013.01)

(58) Field of Classification Search
CPC ..... B41J 2/14233; B41J 2002/14241; B41J 2002/14419; B41J 2002/14491; B41J 2/161; B41J 2/1623
See application file for complete search history.

(56) References Cited

U.S. PATENT DOCUMENTS 7,686,421 B2 * 3/2010 Yasoshima ..... B41J 2/14233 216/27
2014/0184705 A1 7/2014 Wakamatsu et al.

FOREIGN PATENT DOCUMENTS

JP 2014-124882 A 7/2014
JP 2014-124883 A 7/2014
JP 2014-124887 A 7/2014

* cited by examiner

*Primary Examiner* — Geoffrey S Mruk
(74) *Attorney, Agent, or Firm* — Merchant & Gould P.C.

(57) ABSTRACT

A liquid ejection head manufacturing method comprising a step of forming a laminate, a step of connecting and a step of forming a protection film. The laminate includes electrodes and flow paths of liquid. The step of connecting is connecting terminals of a wiring substrate to terminals of the electrodes. The protection film is formed using atomic layer deposition, on a surface of the laminate defining the flow paths after connecting the terminals.

12 Claims, 20 Drawing Sheets

LIQUID EJECTING HEAD AND METHOD FOR MANUFACTURING LIQUID EJECTING HEAD

CROSS-REFERENCE TO RELATED APPLICATION

This application claims priority from Japanese Patent Application No. 2018-052110 filed on Mar. 20, 2018, the content of which is incorporated herein by reference in its entirety.

FIELD OF DISCLOSURE

The disclosure relates to a liquid ejecting head and a method for manufacturing the liquid ejecting head.

BACKGROUND

A liquid ejecting head, e.g., an inkjet recording head, includes a flow channel substrate and piezoelectric actuators disposed on the flow channel substrate. The flow channel substrate includes pressure generating chambers communicating with nozzle openings through which liquid, e.g., ink, is ejected. Each piezoelectric actuator includes a diaphragm. The diaphragm is deformed to cause pressure changes in a pressure generating chamber, thereby ejecting an ink droplet through a corresponding nozzle opening.

SUMMARY

Typically, the piezoelectric actuators include electrodes that are connected to lead electrodes, which may be electrically connected to a wiring substrate including drive circuits. A protection film, which is an insulating film, may be formed on the lead electrodes. This may result in no electrical contact between the lead electrodes and the wiring substrate.

Such problem may arise not only in an inkjet recording head but also in a liquid ejecting heads configured to eject liquid other than ink.

One or more aspects of the disclosure provide a liquid ejecting head including a stack of substrates, an electrode that is connected to a wiring substrate to establish electrical connection therebetween, and a protection film. The protection film may prevent or reduce etching of the substrates by liquid in flow paths in the substrates. The protection film may also prevent or reduce liquid leakage, liquid ejection failure, and/or separation of the substrates.

One or more aspects of the disclosure provide a method for manufacturing the liquid ejecting head readily. A maker forms a laminate including an electrode, the laminate defining a nozzle and a flow path configured to provide liquid communication to the nozzle. The maker connects a first terminal of a wiring substrate to the electrode. The maker forms a protection film on a surface of the laminate after connecting the terminal to the electrode.

DETAILED DESCRIPTION

<Liquid Ejecting Head>

Figure 1:
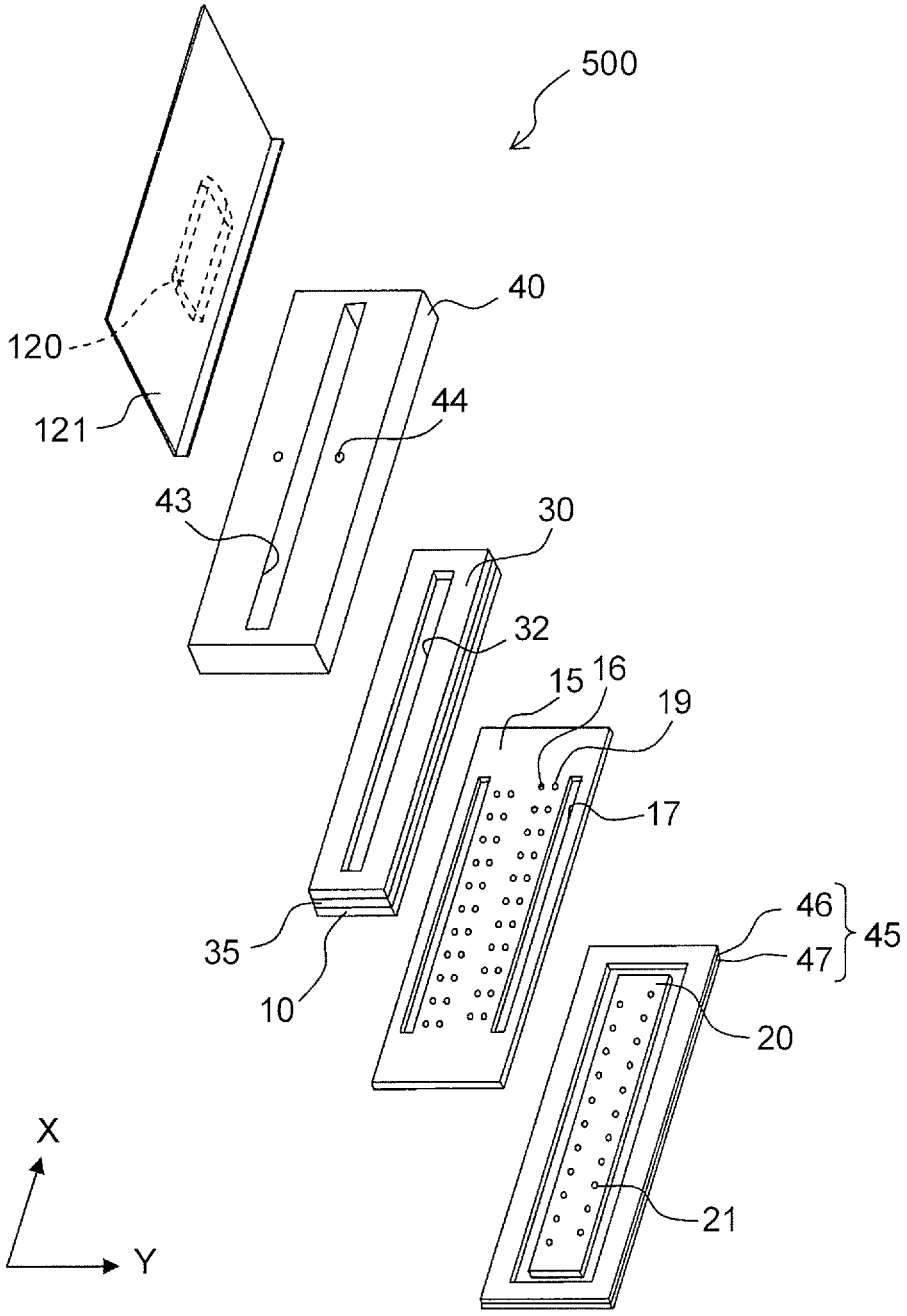
FIG. 1 is an exploded perspective view of a liquid ejecting head in an illustrative embodiment of the disclosure.
Figure 2A:
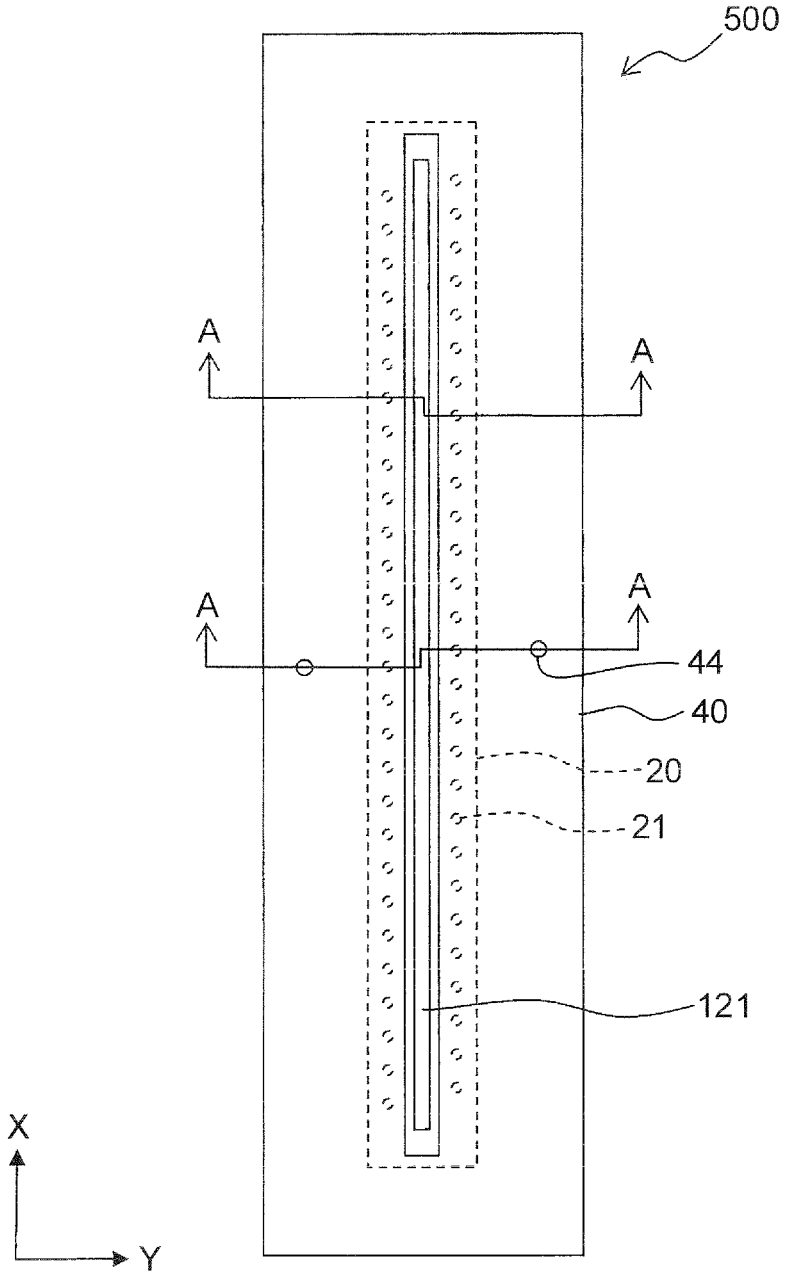
FIG. 2A is a schematic top view of a liquid ejecting head in an illustrative embodiment of the disclosure.
Figure 2B:
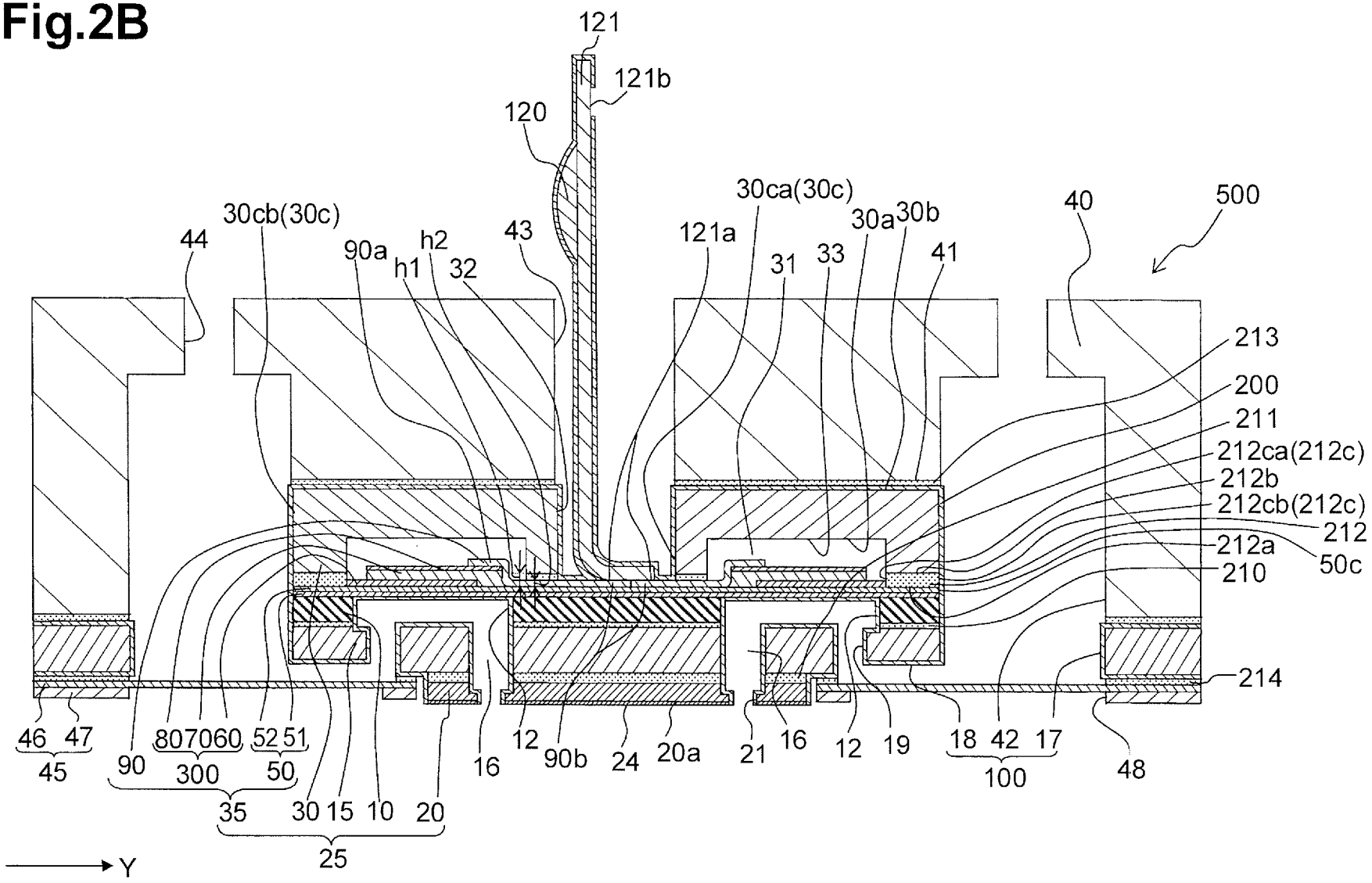
FIG. 2B is a cross-sectional view of the liquid ejecting head in the illustrative embodiment of the disclosure, taken along a line A-A of FIG. 2A.

Referring to FIGS. 1, 2A, and 2B, a liquid ejecting head, e.g., an inkjet recording head 500, according to an illustrative embodiment will be described. FIG. 1 is an exploded perspective view of the inkjet recording head 500. FIG. 2A is a schematic top view of the inkjet recording head 500. FIG. 2B is a cross-sectional view of the inkjet recording head 500, taken along a line A-A of FIG. 2A.

The inkjet recording head 500 includes a plurality of members, which may be attached with, for example, adhesives. In one example, the recording head 500 includes a laminate 25, a wiring substrate 121, a case member 40, and a compliance substrate 45.

(1) Laminate 25

The laminate 25 includes a flow channel substrate 10, a communication plate 15, a nozzle plate 20, a protective member 30, and a device substrate 35.

As depicted in FIG. 1, the flow channel substrate 10 is a plate-like member elongated in a direction X (hereinafter referred to as the first direction X), and has a rectangular upper surface. The flow channel substrate 10 is made of single-crystalline silicon. The flow channel substrate 10 has a plurality of pressure generating chambers 12 that are arranged or aligned in the first direction X, in correspondence with a plurality of nozzle openings 21 for ejecting ink of one same color. The flow channel substrate 10 may include a plurality of arrays of the pressure generating chambers 12. The arrays, each including the pressure generating chambers 12 aligned along the first direction X, may be arranged in a direction Y (hereinafter referred to as the second direction Y). The second direction is orthogonal to the first direction X. In the illustrative embodiment, two arrays of the pressure generating chambers 12 are provided.

The communication plate 15 is provided below the flow channel substrate 10 via an adhesive, and the nozzle plate 20 is provided below the communication plate 15 via an adhesive. In one example, the communication plate 15 is attached to a lower surface of the flow channel substrate 10 via an adhesive 210. The nozzle plate 20 is attached to a lower surface of the communication plate 15, via an adhesive 211. In other words, the nozzle plate 20 is attached, via the adhesive 211, to a surface of the communication plate 15 opposite to the flow channel substrate 10.

The nozzle plate 20 is made of single-crystalline silicon. As depicted in FIG. 1, the nozzle plate 20 is a plate-like member elongated in the first direction X and has a rectangular upper surface. As depicted in the examples of FIGS. 1, 2A, and 2B, the nozzle plate 20 has a plurality of openings (nozzle openings) 21, each communicating with a corresponding one of the pressure generating chambers 12. In the illustrative embodiment, the nozzle plate 20 has a lower surface serving as a liquid ejection surface 20*a* through which liquid, e.g., ink, is ejected. The lower surface of the nozzle plate 20 is opposite to a surface of the nozzle plate 20 to which the communication plate 15 is attached via the adhesive 211.

The nozzle openings 21 in the nozzle plate 20 are aligned in the first direction X. The nozzle openings 21 constitute two nozzle opening arrays, e.g., a first array and a second array, that are arranged in the second direction Y. The nozzle openings 21 in the first and second arrays are arranged in a staggered manner. In other words, the nozzle openings 21 in the first array are not located in the same position in the first direction X as the nozzle openings 21 in the second array. The nozzle plate 20 may include more than two arrays of the nozzle openings 21.

The nozzle plate 20 has a liquid repellent film 24 located on the liquid ejection surface 20*a*. The liquid repellent film 24 has liquid repellency. The liquid repellent film 24 is not limited to a particular film as long as the liquid repellent film 24 is ink-repellent.

The communication plate 15 is made of single-crystalline silicon. As depicted in FIG. 1, the communication plate 15 is a plate-like member elongated in the first direction X and has a rectangular upper surface. As depicted in FIGS. 1 and 2B, the communication plate 15 has communication paths (nozzle communication paths) 16 that connect (or establish communication between) the pressure generating chambers 12 and the nozzle openings 21. As depicted in FIG. 2B, the communication plate 15 includes first manifolds 17 and second manifolds 18. Each first manifold 17 extends through the communication plate 15 in its thickness direction (e.g., a direction in which the communication plate 15 and the flow channel substrate 10 are stacked). Each second manifold 18 does not extend through the communication plate 15 in the thickness direction but is open toward the liquid ejection surface 20*a*. The first manifold 17 and the second manifold 18 communicate with each other. The communication plate 15 further includes ink paths 19, each communicating with one end of a corresponding pressure generating chamber 12 in the second direction Y. The ink paths 19 are provided for the respective pressure generating chambers 12. An ink path 19 establishes communication between the second manifold 18 and a corresponding pressure generating chamber 12.

The communication plate 15 has an area greater than the flow channel substrate 10. The nozzle plate 20 has an area smaller than the flow channel substrate 10. The nozzle plate 20 having a relatively small area may achieve cost reduction.

Each of the communication plate 15, the flow channel substrate 10, and the nozzle plate 20 is made of single-crystalline silicon, and has a same coefficient of linear expansion. This may prevent or reduce warp or curvature of the communication plate 15, the flow channel substrate 10, and the nozzle plate 20, due to the application of heating or cooling. The communication plate 15, the flow channel substrate 10, and the nozzle plate 20 may be made of material other than single-crystalline silicon.

The device substrate 35 is disposed on an upper surface of the flow channel substrate 10, which is opposite to the lower surface of the flow channel substrate 10. The device substrate 35 includes a diaphragm 50, piezoelectric elements 300, and lead electrodes 90. The piezoelectric elements 300 and the lead electrodes 90 are disposed above the diaphragm 50. Each lead electrode 90 includes a first connecting terminal 90*a* disposed at an end thereof and a second connecting terminal 90*b* disposed at the other end thereof.

The diaphragm 50 has a lower surface facing the flow channel substrate 10, an upper surface, which is opposite to the lower surface and faces the protective member 30 (described in detail below), and side surfaces 50*c* located between the upper surface and the lower surface.

The diaphragm 50 includes an elastic film 51 disposed on the upper surface of the flow channel substrate 10, and an insulating film 52 disposed on the elastic film 51.

Each piezoelectric element 300, which serves as a pressure generating unit, is disposed above the diaphragm 50. The piezoelectric element 300 includes a first electrode 60, a piezoelectric layer 70, and a second electrode 80. The piezoelectric element 300 and the diaphragm 50 constitute a piezoelectric actuator. In general, one of the first electrode 60 and the second electrode 80 is used as a common electrode. The other one of the first electrode 60 and the second electrode 80, as well as the piezoelectric layer 70 are patterned for each pressure generating chamber 12, and the other one of the first electrode 60 and the second electrode 80 that is patterned is used as an individual electrode. A portion that includes the other one of the electrodes 60 and 80 and the piezoelectric layer 70, and that deforms with the application of a voltage to both electrodes 60 and 80 is referred to as a "piezoelectric active portion". In the illustrative embodiment, the first electrode 60 is used as a common electrode of the piezoelectric element 300, and the second electrode 80 is used as an individual electrode of the piezoelectric element 300. In another embodiment, for convenience of drive circuits or wiring, the first electrode 60 may be used as an individual electrode and the second electrode 80 may be used as a common electrode. The elastic film 51 of the diaphragm 50 and the flow channel substrate 10 define the pressure generating chambers 12.

The first electrode 60 is disposed on the diaphragm 50. The piezoelectric layer 70 is disposed on the first electrode 60. The piezoelectric layer 70 may be made of a piezoelectric material of an oxide having a polarization structure. For example, the piezoelectric layer 70 may be made of perovskite oxide which is represented by a general formula $ABO_3$, where A may represent lead, and B may represent at least one of zirconium and titanium. For example, furthermore, B may represent niobium. Specifically, as a piezoelectric layer 70, for example, lead zirconate titanate ($Pb(Zr, Ti)O_3$: PZT), or lead zirconate titanate niobate including silicon ($Pb(Zr, Ti, Nb)O_3$: PZTNS), may be used. The piezoelectric layer 70 may be made of composite oxide having a perovskite structure including a lead-free piezoelectric material, which does not include lead, such as bismuth ferrate, bismuth manganate ferrate, barium titanate, and bismuth potassium titanate.

The second electrode 80 is disposed on the piezoelectric layer 70. The second electrode 80 is connected with the first connecting terminal 90*a* of the lead electrode 90, which extends in the second direction Y. The first connecting terminal 90*a* is located on the second electrode 80. The second connecting terminal 90*b* is connected with a connecting terminal 121*a* of the wiring substrate 121.

The diaphragm 50 may not necessarily include the elastic film 51 and the insulating film 52. For example, the diaphragm 50 may include either one of the elastic film 51 and the insulating film 52. The diaphragm 50 may not include the elastic film 51 or the insulating film 52, but the first electrode 60 may serve as a diaphragm. Alternatively, the piezoelectric element 300 may substantially serve as a diaphragm. If the first electrode 60 is disposed directly on the flow channel substrate 10, the first electrode 60 needs to be protected by an insulating film (e.g., a protection film 200, which will be described below) to prevent ink from contacting the first electrode 60.

The protective member 30 is disposed above the device substrate 35. The protective member 30 is attached to the device substrate 35, via an adhesive (an adhesive layer) 212. The protective member 30 has a size substantially the same as the flow channel substrate 10. The protective member 30 is made of single-crystalline silicon and is a silicon single crystallin substrate. In another embodiment, the protective member 30 may be made of other material than single-crystalline silicon.

As depicted in FIG. 1, the protective member 30 has a rectangular shape. As depicted in FIG. 2B, the protective member 30 includes a lower surface 30*a* facing the device substrate 35 (e.g., the diaphragm 50), an upper surface of 30*b* opposite to the lower surface 30*a*, and side surfaces 30*c* extending between the lower surface 30*a* and the upper surface 30*b*. The protective member 30 has a slot 32 extending through the lower surface 30*a* and the upper surface 30*b* in a thickness direction of the protective member 30. The slot 32 may have a rectangular shape whose longitudinal direction corresponds to the first direction X. The lower surface 30*a* of the protective member 30 has recess portions 33. Each recess portion 33 of the protective member 30 and the upper surface of the diaphragm 50 define a protective space 31. The piezoelectric element 300 is located in the protective space 31. The protective member 30 thus protects the piezoelectric element 300. In the protective space 31, the first connecting terminal 90*a* of the lead electrode 90 is connected to the second electrode 80 of the piezoelectric element 300. The side surfaces 30*c* of the protective member 30 include a surface (e.g., a first surface) 30*ca* defining a portion of the slot 32, and another surface (e.g., a second surface) 30*cb* facing the surface 30*ca* across the protective space 31. The lead electrode 90 extends in the second direction Y through a portion between the surface 30*ca* of the protective member 30 and the diaphragm 50. A portion of the lead electrode 90 (e.g., the first connecting terminal 90*a*) is located in the protective space 31 while another portion (e.g., the second connecting terminal 90*b*) of the lead electrode 90 is located in the slot 32, which is out of the protective space 31. In other words, the surface 30*ca* of the protective member 30 is located between the first connecting terminal 90*a* and the second connecting terminal 90*b* in the second direction Y. In the slot 32, the second connecting terminal 90*b* may be electrically connected to the connecting terminal 121*a* of the wiring substrate 121.

The adhesive layer 212, which attaches the device substrate 35 to the protective member 30, includes a lower surface 212*a* contacting the device substrate 35, an upper surface 212*b* contacting the protective member 30, and side surfaces 212*c* between the lower surface 212*a* and the upper surface 212*b*. The side surfaces 212*c* include a first surface 212*ca* exposed to the protective space 31 and a second surface 212*cb* opposite to the first surface 212*ca*.

The adhesive layer 212 has a height $h_1$, which is a thickness of the adhesive layer 212 between the diaphragm 50 and the protective member 30. The height $h_1$ is greater than a height (thickness) $h_2$ of the lead electrode 90. This may seal the protective space 31 and thus prevent the protection film 200, which is formed or deposited using atomic layer deposition (ALD) as will be described below, from attaching or adhering to the piezoelectric element 300 in the protective space 31. The height $h_1$ of the adhesive layer 212 may be, for example, approximately 1.5 μm. The height $h_2$ of the lead electrode 90 may be, for example, approximately 1 μm. In another embodiment, the height $h_1$ of the adhesive layer 212 may be the same as the height $h_2$ of the lead electrode 90.

A recess portion 33 of the protective member 30 may be disposed, surrounding the slot 32. Alternatively, two recess portions 33, each extending in the first direction X, may be arranged in the second direction Y, sandwiching the slot 32 between the two recess portions 33. Configuration, such as shapes and arrangements, of the protective member 30 and the recess portion 33 may not be limited to particular configuration as long as a protective space 31 is provided for each piezoelectric element 300 without impeding the movement or deformation of the diaphragm 50.

The laminate 25 includes flow paths, each having the opening 21 in the liquid ejection surface 20*a*, the communication path 16, the pressure generating chamber 12, the ink path 19, the second manifold 18, and the first manifold 17. The protection film 200 is formed on an inner wall of the flow path (e.g., on a surface defining the flow path). The inner wall of the flow path is constituted by the flow channel substrate 10, the communication plate 15, the nozzle plate 20, and the protective member 30, as well as the adhesives 210-212 attaching those elements 10, 15, 20, and 30. The protection film 200 completely covers or coats, without any openings, such as gaps, joints, and seams, all of the elements 10, 15, 20, and 30, and the adhesives 210-212. Since the protection film 200 covers the adhesives 210-212 as well in addition to the elements 10, 15, 20, and 30, such possibilities may be reduced that ink directly contacts the adhesives 210-212 and interfaces between the adhesives 210-212 and the flow channel substrate 10, the communication plate 15, the nozzle plate 20, and the protective member 30. Accordingly, adhesive strengths of the adhesives may not be reduced due to etching by ink. The protection film 200 completely covers the inner walls of the flow paths. This may prevent occurrences of entry of ink through an opening in the protection film 200, which may cause etching of the flow channel substrate 10, the communication plate 15, the nozzle plate 20, the protective member 30, and/or the adhesives 210-212. Those elements 10, 15, 20, and 30, and the adhesives 210-212 may thus be protected reliably.

The protection film 200 includes, as a main component, at least one material selected from tantalum oxide (TaOx), hafnium oxide (HfOx), aluminum oxide (AlOx) or zirconium oxide (ZrOx). These materials have high ink resistance, so that the laminate 25 may be effectively prevented or reduced from being etched by ink. The ink resistance (liquid resistance) as used in this document means a resistance to etching by an alkaline or acid ink (liquid). More specifically, $Ta_2O_5$(TaOx), if its film has a high density (approximately 7 g/cm$^2$), is unlikely to be dissolved in alkalis and is insoluble in acid solutions other than hydrogen fluoride solutions. $Ta_2O_5$(TaOx) is thus effective for a protective film against strong alkaline solutions and/or strong acid solutions. $ZrO_2$ (ZrOx) is insoluble in alkalis and solutions other than sulfuric acid solutions and hydrofluoric acid solutions. $ZrO_2$ (ZrOx) is effective for a protective film against strong alkaline solutions and/or strong acid solutions. $HfO_2$ (HfOx) is insoluble in alkalis and acids. $HfO_2$ (HfOx) is thus effective for a protective film against strong alkaline solutions and strong acid solutions. AlOx has a high corrosion resistance to alkalis and acids. AlOx may readily form a dense film. AlOx is thus effective for a protective film against alkalis, acids, organic solvents, and water vapor or steam. The protection film 200 may be a single layer formed of single or composite material, or a stack of layers formed of a plurality of materials.

The thickness of the protection film 200 may be in a rage from 1 nm to 50 nm inclusive, e.g., from 10 nm to 30 nm inclusive. As will be described in detail below, the protection film 200 is formed using atomic layer deposition. With atomic layer deposition, the protection film 200 having a relatively thin thickness of 50 nm or less may be readily formed. In addition, the protection film 200 formed by atomic layer deposition has a high film density, so that the protection film 200 with a thickness of 1 nm or more may have sufficient ink resistance. The protection film 200 having a thickness greater than its upper limit (e.g., 50 nm) may lead to increased time and costs. The protection film 200 having a thickness less than its lower limit (e.g., 1 nm) may lead to non-uniform film with respect to its thickness and quality.

Use of the protection film 200 having a smaller thickness may reduce such possibilities that the protection film 200 blocks or impedes the movement or deformation of the diaphragm 50. The protection film 200 having a smaller thickness may allow the diaphragm 50 to deform more greatly than the protection film 200 having a greater thickness if the thickness of the piezoelectric element 300 is the same. The thin protection film 200 may ensure sufficient volumetric capacities for the pressure generating chambers 12 in the flow channel substrate 10 if the substrate 10 is thin. The thin protection film 200 may lead to the thinned inkjet recording head 500 with highly dense arrangement of the nozzle openings 21.

The protection film 200 is also formed or deposited on a surface of the laminate 25 other than the inner walls of the flow paths. For example, the protection film 200 covers the surfaces of the protective member 30, e.g., the surfaces (the first surfaces) 30*ca* that define portions of the slot 32, the surfaces (the second surfaces) 30*cb* facing the surfaces 30*ca*, and the upper surface 30*b*. The protection film 200 also covers portions of the lead electrodes 90 and the diaphragm 50 that are located in the slot 32 and do not contact the wiring substrate 121. The protection film 200 also covers the side surfaces of the flow channel substrate 10 between the upper and lower surfaces of the flow channel substrate 10, and the side surfaces 50*c* of the diaphragm 50, as well as the second surfaces 212*cb* of the adhesive layer 212 that attaches the device substrate 35 and the protective member 30 to each other. The protection film 200 is provided to cover those surfaces and portions completely without an opening such as a gap and joint.

The first surfaces 30*ca* of the protective member 30 are covered by the protection film 200. This configuration may prevent the protective member 30 from being etched by ink that is accidentally entered in the slot 32 during manufacturing (assembly) of the recording head 500. The upper surface of 30*b* of the protective member 30 is covered by the protection film 200. This configuration may prevent the protective member 30 from being etching by ink entered into a portion between the protective member 30 and the case member 40, and also may prevent the ink from leaking into the slot 32. The second surfaces 30*cb* of the protective member 30, the side surfaces 50*c* of the diaphragm 50, and the second surfaces 212*cb* of the adhesive layer 212 are all covered by the protection film 200 completely without an opening. This configuration may prevent ink from entering through a portion between the device substrate 35 and the protective member 30 and leaking into the protective space 31.

The protection film 200 is not formed on surfaces or portion of the second connecting terminals 90*b* of the lead electrodes 90 where the second connecting terminals 90*b* contact the wiring substrate 121 (e.g., between the lead electrodes 90 and the wiring substrate 121). This may establish electrical connection between the lead electrodes 90 and the wiring substrate 121.

(2) Wiring Substrate 121

The wiring substrate 121 may be a flexible substrate including a drive circuit 120, such as a chip on film ("COF"). The wiring substrate 121 includes connecting terminals 121*a* at one end thereof. The connecting terminals 121*a* may be electrically connected to the second connecting terminals 90*b* of the lead electrodes 90. The wiring substrate 121 includes another connecting terminals 121*b* at the other end thereof. The connecting terminals 121*b* may be used for electrical connection with an electronic member that includes circuits for controlling liquid ejecting operations of the recording head 500, and electronic components such as resistors. The wiring substrate 121 does not necessarily include the drive circuit 120. In short, the wiring substrate 121 is not limited to the COF but may be a flexible flat cable ("FFC") or a flexible printed circuit ("FPC").

The protection film 200 is formed on surfaces of the wiring substrate 121 (except for portions contacting the lead electrodes 90). This may enhance resistance of the wiring substrate 121 to liquid, e.g., ink. The protection film 200 covers a surface of the drive circuit 120. The protection film 200 is not formed on portions of the connecting terminals 121*a* contacting or connected to the second connecting terminals 90*b* of the lead electrode 90. In other words, the protection film 200 is not formed on contact portions of the wiring substrate 121 to the lead electrodes 90. This may allow for electrical connection between the wiring substrate 121 and the lead electrodes 90. The protection film 200 is not formed on the connecting terminals 121*b*. This may allow for electrical connection between the wiring substrate 121 and the electronic member.

(3) Case Member 40

The case member 40 is fixed to the laminate 25, via an adhesive 213. The case member 40 has a shape substantially the same as the communication plate 15 in plan view. The case member 40 is fixed, via the adhesive 213, to the protective member 30 and the communication plate 15. The case member 40 includes a recess portion 41 recessed into a surface of the case member 40 facing the laminate 25. The recess portion 41 has a depth to accommodate the flow channel substrate 10 and the protective member 30. The recess portion 41 has an area greater than a surface of the protective member 30 attached to the device substrate 35. The case member 40 and the laminate 25 define third manifolds 42 adjacent to the recess portion 41. The third manifolds 42 fluidly communicate with the respective first manifolds 17. The first manifold 17 and the second manifold 18 that are provided in the communication plate 15, and the third manifold 42 defined by the case member 40 and the laminate 25 constitute a manifold 100.

Examples of materials of the case member 40 may include resin and metal. The case member 40 may be molded of resin, thereby producing the recording head 500 at low costs.

The case member 40 includes introduction paths 44, each communicating with a corresponding manifold 100. Through the introduction path 44, ink flows into the manifold 100. The case member 40 has a port 43 through which the wiring substrate 121 is inserted. The port 43 connects to the slot 32.

(4) Compliance Substrate 45

The compliance substrate 45 is disposed below the communication plate 15. The compliance substrate 45 seals an end (e.g., a lower end) of the openings of the first manifold 17 and the second manifold 18 closer to the liquid ejection surface 20*a*. In other words, the compliance substrate 45 defines a portion of the manifold 100.

The compliance substrate 45 includes a sealing film 46 and a fixed substrate 47. The sealing film 46 is a flexibility thin film having a thickness of 20 μm or less, and is made of material, for example, polyphenylene sulfide (PPS) or stainless steel (SUS). The fixed substrate 47 is made of rigid material such as metal, e.g., stainless steel (SUS). The fixed substrate 47 has openings 48 at portions of the fixed substrate 47 facing the manifolds 100. Each opening 48 extends through the fixed substrate 47 in its thickness direction. The manifold 100 is sealed on its end closer to the liquid ejection surface 20*a* (e.g., a lower end) by the flexible sealing film 46. The sealing film 46 may absorb pressure variations in the manifolds 100 when the recording head 500 is in operation.

<Operations of Liquid Ejecting Head>

The following describes how the liquid ejecting head, e.g., the inkjet recording head 500, ejects ink. Ink in an ink supply, e.g., a cartridge, flows into the manifolds 100 via the introduction paths 44. The flow paths extending from the manifold 100 to the nozzle opening 21 is filled with the ink. Based on a signal from the drive circuit 120, voltage is applied to the piezoelectric element 300 corresponding to the pressure generating chamber 12, thereby causing the piezoelectric element 300 to deform together with the elastic film 51 and the insulating film 52. Accordingly, pressures in the pressure generating chamber 12 increase and an ink droplet is ejected through the nozzle opening 21.

<Method for Manufacturing Liquid Ejecting Head>

Figure 3:
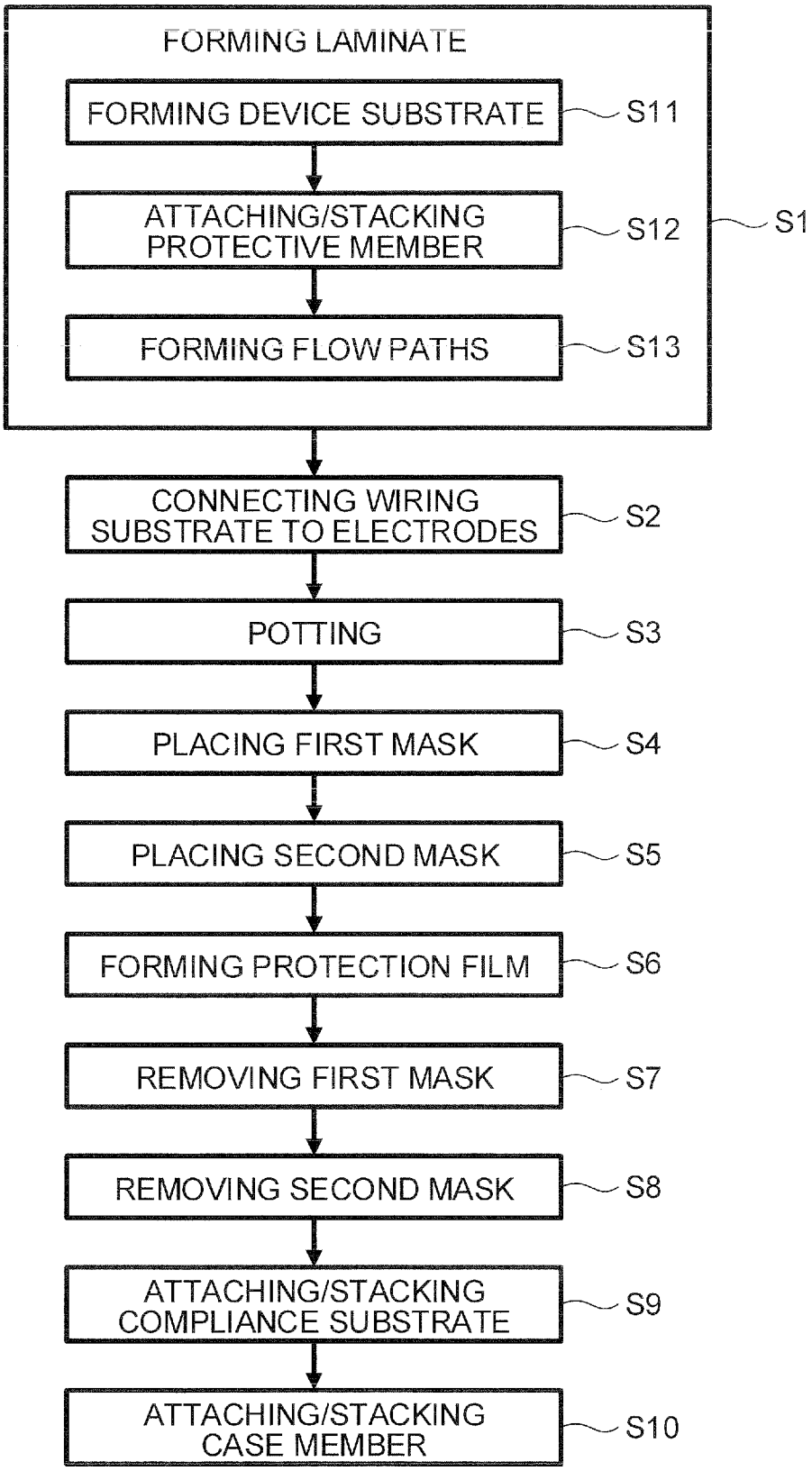
FIG. 3 is a flowchart illustrating steps for manufacturing a liquid ejecting head in an illustrative embodiment of the disclosure.

As depicted in FIG. 3, a method for manufacturing a liquid ejecting head may include steps of: forming a laminate including electrodes and flow paths of liquid (liquid flow paths) (S1); connecting connecting terminals of the wiring substrate to connecting terminals of the electrodes (S2), potting portions of the electrodes with resin (S3); placing a first mask on another connecting terminals of the wiring substrate (S4); placing a second mask on a surface of the laminate (e.g., a first surface having openings for ejecting liquid) (S5); forming a protection film, using atomic layer deposition, on a surface of the laminate defining the liquid flow paths (S6); removing the first mask (S7); removing the second mask (S8); attaching or stacking a compliance substrate (S9); and attaching or stacking a case member (S10). Step S1 of forming a laminate includes steps of: forming a device substrate including the electrodes (S11); attaching/stacking a protective member including a recess portion to/on the device substrate (S12); and forming liquid flow paths (S13). Referring to FIGS. 4-15, those steps will now be described. FIGS. 4-15 illustrate conceptually illustrate those steps or processes for manufacturing a liquid ejecting head, e.g., the inkjet recording head 500, as depicted in FIGS. 2A and 2B.

(1) Forming Device Substrate (S11)

Figure 4A:
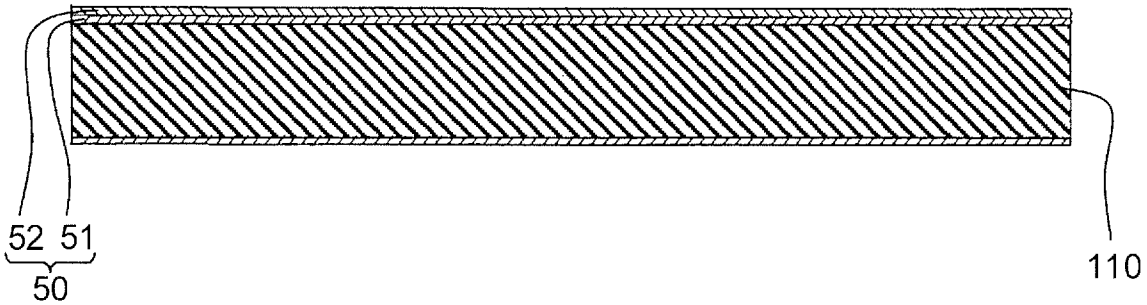
FIGS. 4A and 4B conceptually illustrate processes of forming a device substrate in an illustrative embodiment of the disclosure.

A wafer 110 is prepared for a flow channel substrate. The wafer 110 may be a silicon wafer. As depicted in FIG. 4A, the diaphragm 50 is formed or provided on a surface of the wafer 110. If the wafer 110 is a silicon wafer, the wafer 110 is subjected to thermal oxidation, thereby forming the elastic film 51 of silicon dioxide. Further, zirconium is sputtered to form a film. The film is thermally oxidized to form the insulating film 52 of zirconium oxide. The diaphragm 50 having layers of the elastic film 51 and the insulating film 52, is thus formed.

The diaphragm 50 may not necessarily be formed of silicon dioxide and zirconium oxide. Examples of materials of the diaphragm 50 may include silicon nitride ($Si_3N_4$), titanium oxide ($TiO_2$), aluminum oxide ($Al_2O_3$), hafnium oxide ($HfO_2$), magnesium oxide (MgO), and lanthanum aluminate ($LaAlO_3$). The elastic film 51 may be formed by other methods than thermal oxidation, such as sputtering, a chemical vapor deposition ("CVD"), evaporation, spin coating or in combination thereof.

Figure 4B:
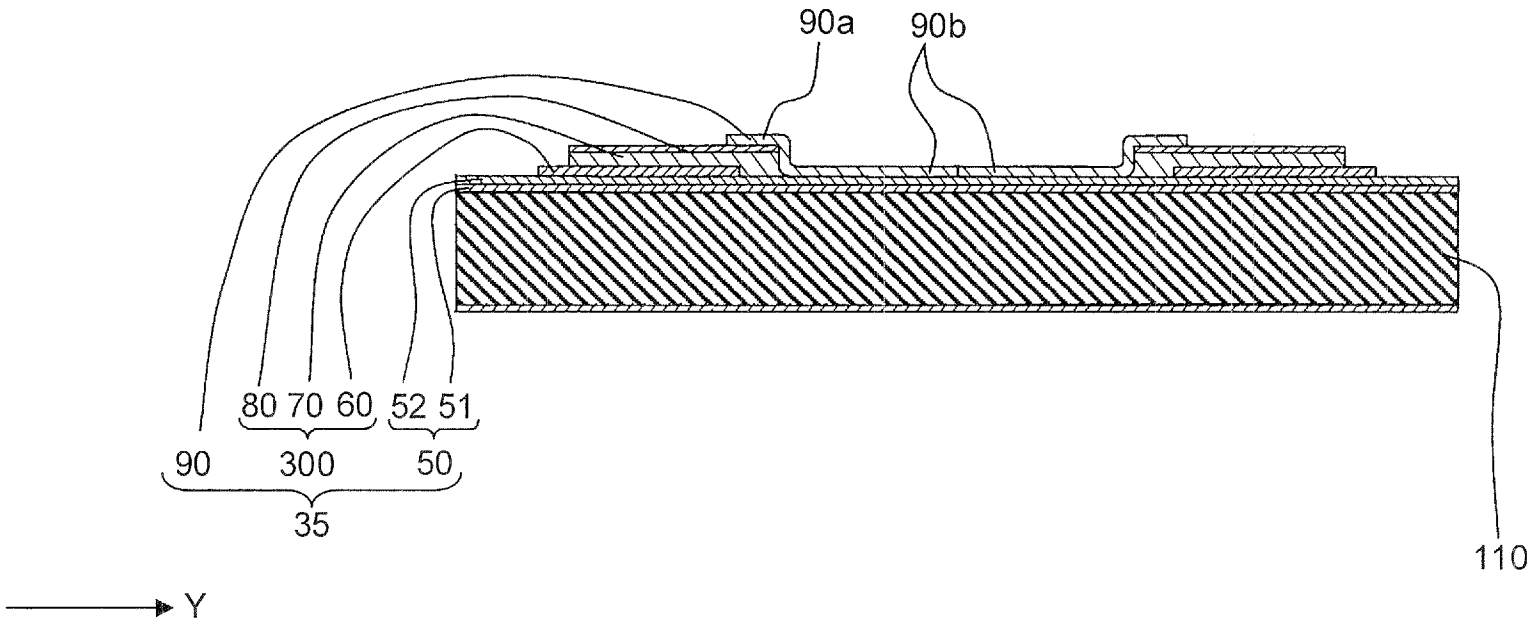

Thereafter, as depicted in FIG. 4B, the piezoelectric elements 300 and the lead electrodes 90 are formed or provided on the diaphragm 50. The layers of the piezoelectric element 300 (e.g., the first electrode 60, the piezoelectric layer 70, and the second electrode 80) and the lead electrode 90 may be provided for each pressure generating chamber 12 by forming films and a lithography method. The piezoelectric layer 70 may be formed using, for example, physical vapor deposition ("PVD"), such as sol-gel deposition, metal-organic decomposition ("MOD"), sputtering, or laser ablation. The device substrate 35, which includes the diaphragm 50, the first electrode 60, the piezoelectric layer 70, the second electrode 80, and the lead electrode 90, is thus formed on the wafer 110.

(2) Attaching/Stacking Protective Member (S12)

Figure 5:
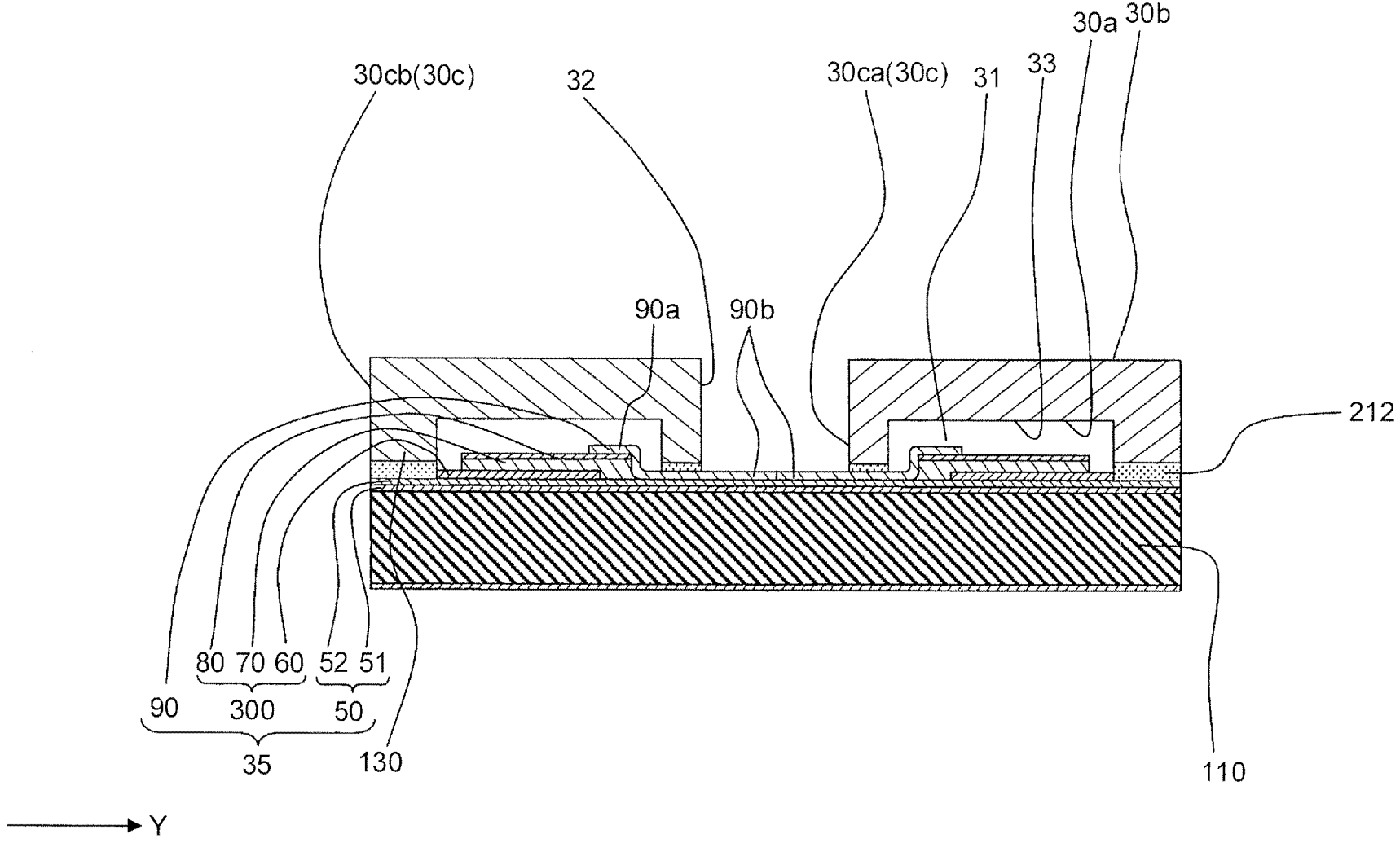
FIG. 5 conceptually illustrates a process of attaching or staking a protective member in an illustrative embodiment of the disclosure.

As depicted in FIG. 5, a wafer 130 for protective members is attached to a surface (e.g., an upper surface) of the device substrate 35 closer to the piezoelectric element 300, via the adhesive 212. The wafer 130 may be a silicon wafer. The wafer 130 includes a plurality of protective members 30 arranged thereon. For each of the protective members 30, the recess portions 33 and the slot 32 are provided. The wafer 130 for the protective members and the wafer 110 for the flow channel substrate are attached to each other, such that: the piezoelectric element 300 is disposed in the protective space 31 defined by the recess portion 33; a portion (e.g., the first connecting terminal 90*a*) of the lead electrode 90 connected to the piezoelectric element 300 is located in the protective space 31; and another portion (e.g., second connecting terminal 90*b*) of the lead electrode 90 is located in the slot 32. A method for forming the recess portions 33 and the slots 32 in the wafer 130 is not limited to a particular method. For example, the recess portions 33 and the slots 32 may be formed, for example, by anisotropic etching using the alkaline solution such as potassium hydroxide ("KOH"). This etching method may form the recess portions 33 and the slots 32 with high accuracy.

(3) Forming Flow Paths (S13)

Figure 6A:
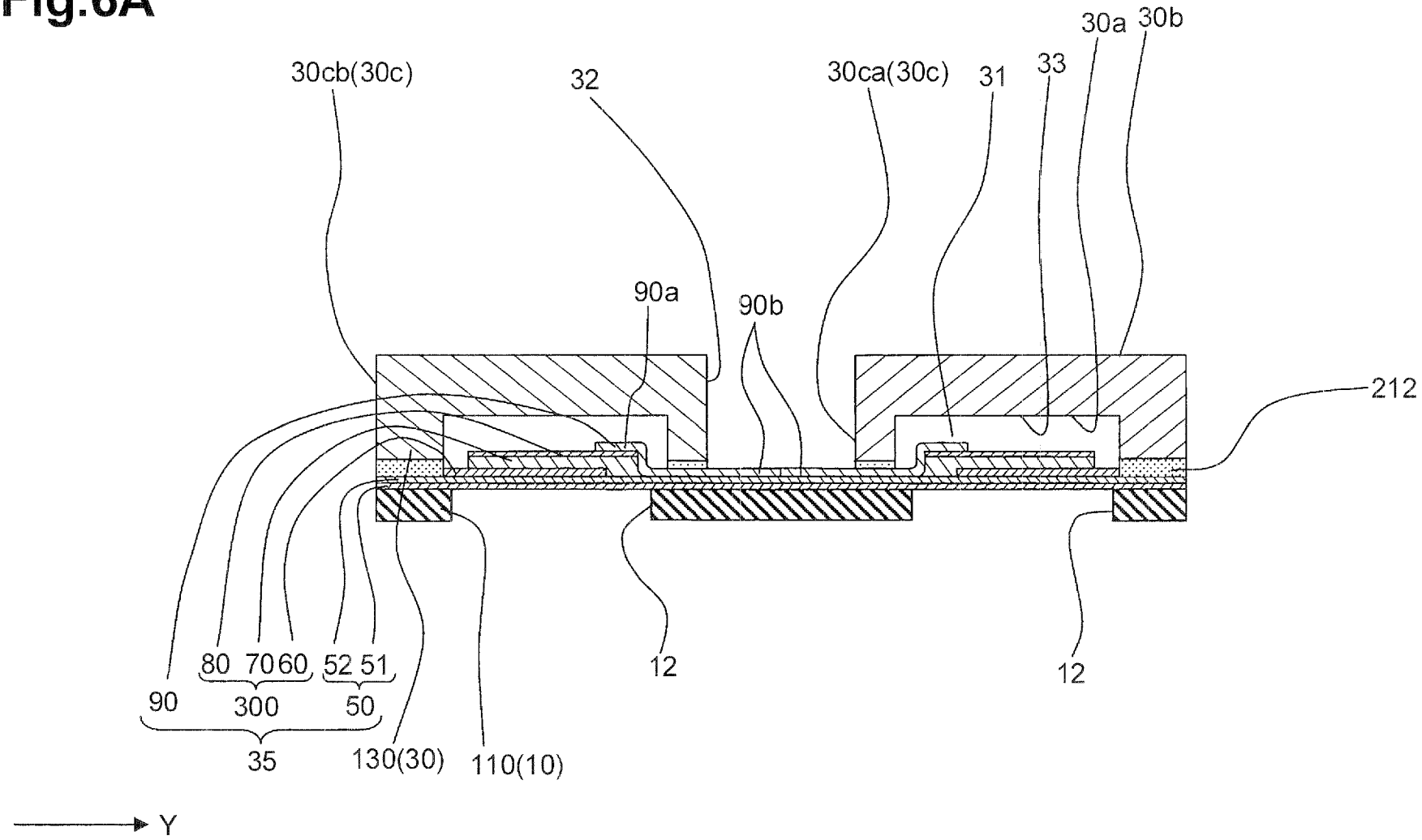
FIGS. 6A through 6C conceptually illustrate processes of forming liquid flow paths in an illustrative embodiment of the disclosure.

As depicted in FIG. 6A, the wafer 110 is thinned down to a predetermined thickness and is then subjected to anisotropic etching. The anisotropic etching is performed, via a mask (not depicted), from a surface of the wafer 110 opposite to the wafer 130, thereby forming the pressure generating chambers 12 in correspondence with the piezoelectric elements 300. Further, unnecessary portions of the wafer 110 and the wafer 130 are removed. The wafer 110 and the wafer 130 are divided into one chip size as depicted in FIG. 1. The flow channel substrate 10 and the protective member 30 are thus obtained from the wafer 110 and the wafer 130, respectively.

Figure 6B:
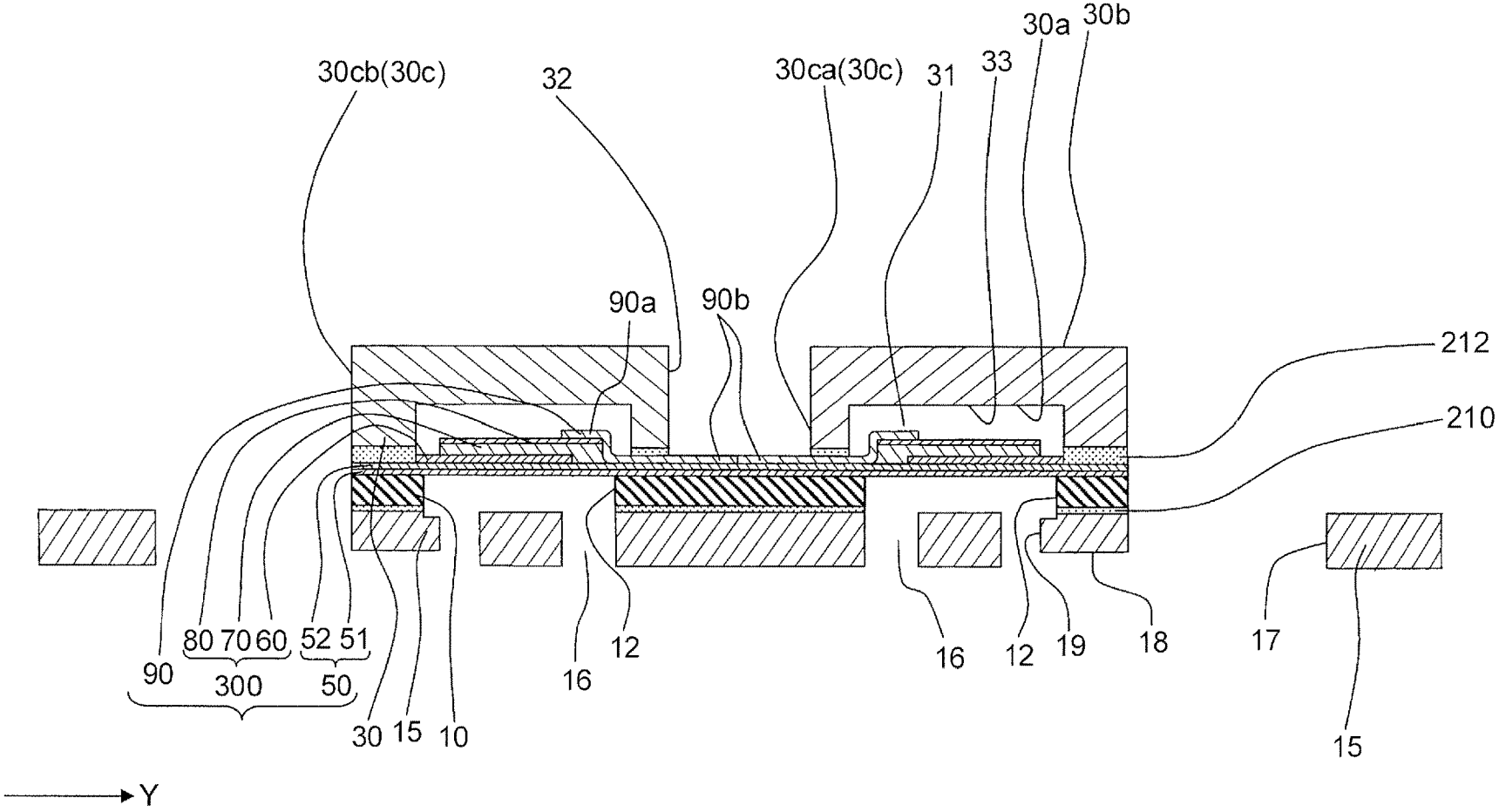

As depicted in FIG. 6B, the communication plate 15 is attached to the flow channel substrate 10 via the adhesive 210. The communication plate 15 has the nozzle communication paths 16, the first manifolds 17, the second manifolds 18, and the ink paths 19 formed in advance before attaching to the flow channel substrate 10.

Figure 6C:
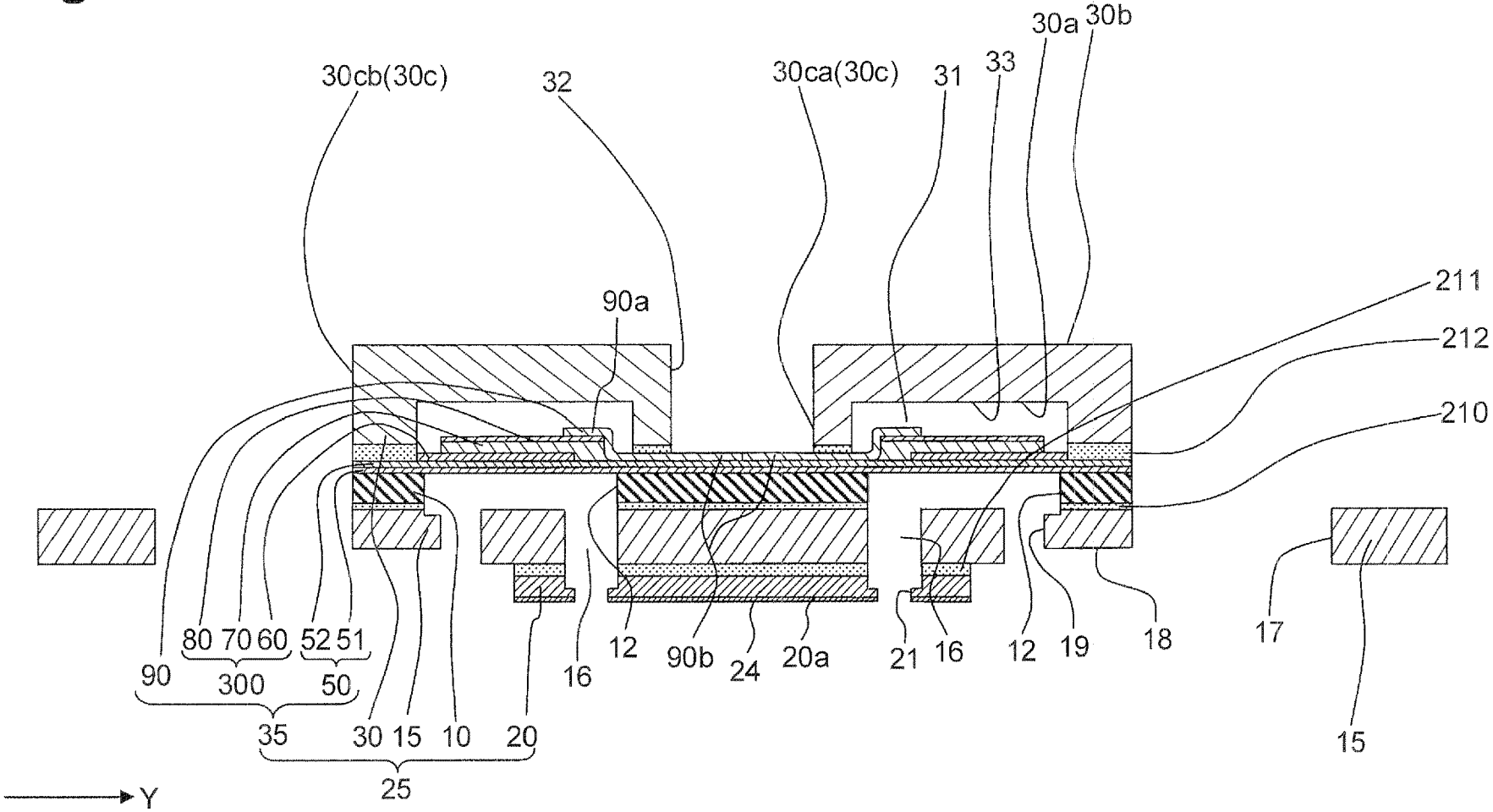

Thereafter, as depicted in FIG. 6C, the nozzle plate 20 is attached to the communication plate 15, via the adhesive 211. The nozzle plate 20 has the nozzle openings 21 formed in advance before attaching to the communication plate 15. The nozzle openings 21 fluidly communicate with the corresponding pressure generating chambers 12 via the nozzle communication paths 16. The laminate 25 is thus formed that includes the flow channel substrate 10, the communication plate 15, the nozzle plate 20, the protective member 30, and the device substrate 35.

The liquid ejection surface 20*a* of the nozzle plate 20 may have the liquid repellent film 24 formed thereon in advance before the nozzle plate 20 is attached to the communication plate 15. For example, a metal alkoxide monolayer film having liquid repellency is formed on the liquid ejection surface 20*a*, and is then subjected to processing, such as drying and annealing, to have the liquid repellent film 24.

(4) Connecting Wiring Substrate to Electrodes (S2)

Figure 7:
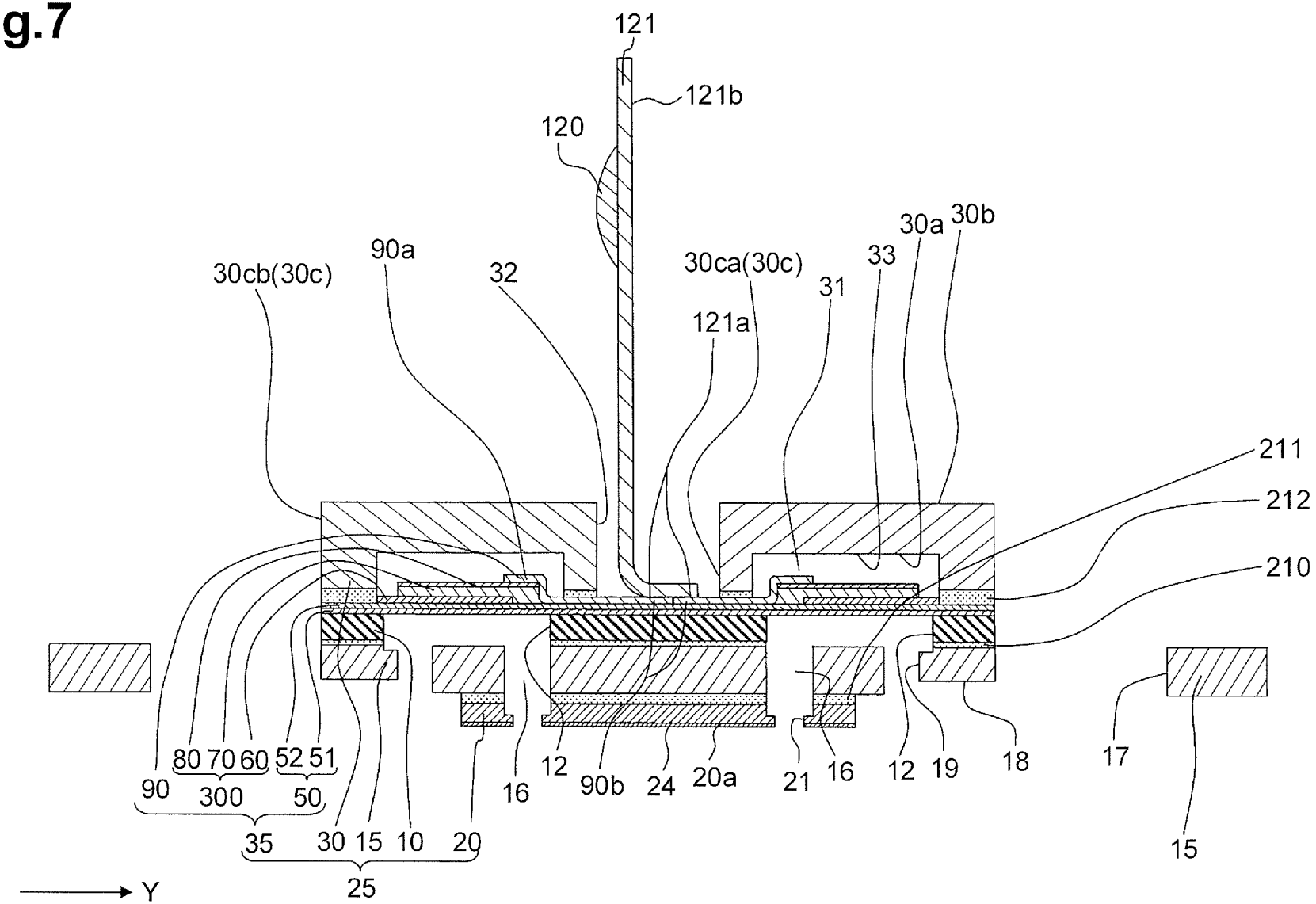
FIG. 7 conceptually illustrates a process of connecting a wiring substrate to electrodes in an illustrative embodiment of the disclosure.

As depicted in FIG. 7, in the slot 32, the connecting terminals 121*a* of the wiring substrate 121 are connected to the second connecting terminals 90*b* of the lead electrodes 90 such that electrical connection may be established between the connecting terminals 121*a* and the second connecting terminals 90*b*. The method for connecting the connecting terminals 121*a* to the second connecting terminals 90*b* for electrical connection therebetween is not limited to a particular method.

(5) Potting (S3)

Figure 8:
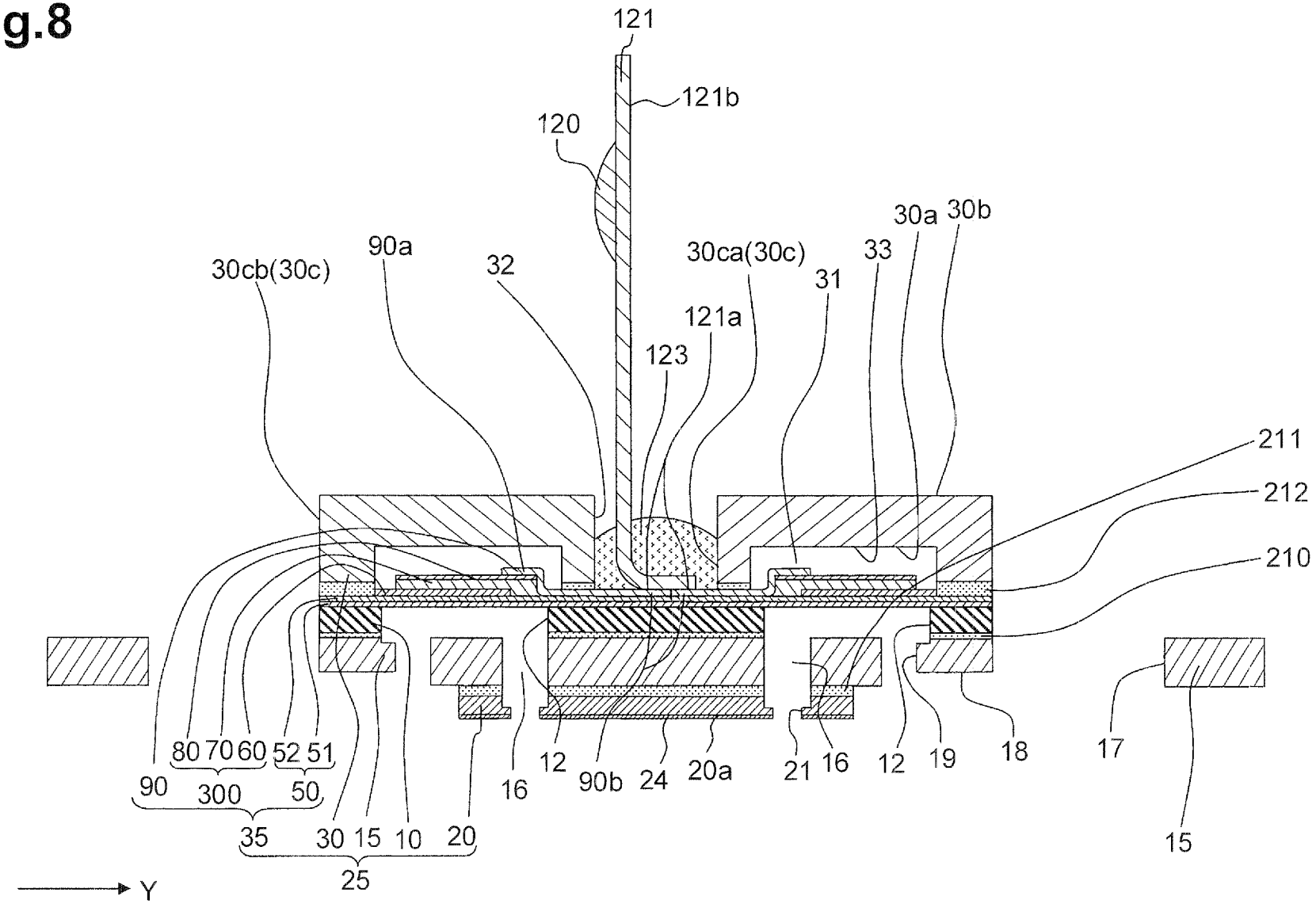
FIG. 8 conceptually illustrates a process of potting in an illustrative embodiment of the disclosure.

As depicted in FIG. 8, potting is performed on (e.g., potting material is applied to) intersecting portions between the lead electrodes 90 and the surfaces (the first surfaces) 30*ca* of the protective member 30 that define portions of the slot 32, as well as a region (e.g., an attaching region) where the connecting terminals 121*a* of the wiring substrate 121 are attached to the second connecting terminals 90*b* of the lead electrodes 90. The attaching region refers to a region above an upper surface of the wiring substrate 121 opposite to its lower surface having the connecting terminals 121*a*. The attachment region does not include portions of a surface (e.g., the lower surface) of the wiring substrate 121 contacting the lead electrodes 90. The intersecting portions and the attaching region, which may be collectively referred to as the "electrical connecting portion", may be covered by the resin 123. The intersecting portions between the lead electrodes 90 and the first surfaces 30*ca* of the protective member 30 are covered by the resin 123, thereby sealing the protective spaces 31. This configuration may prevent the protection film 200 (whose forming step will be described below) from attaching or adhering to the piezoelectric elements 300 in the protective spaces 31. The attaching region, where the second connecting terminals 90*b* and the connecting terminals 121*a* are attached, may be covered by the resin 123, so that the lead electrodes 90 may not be separated from the wiring substrate 121 due to external force applied, in subsequent steps, to the wiring substrate 121. The protection film 200 may be prevented from attaching to the attaching region. This may prevent or reduce poor electrical connection between the lead electrodes 90 and the wiring substrate 121. Either one of the attaching region and the intersecting portions between the lead electrodes 90 and the first surfaces 30*ca* of the protective member 30, may be covered by resin. The material used for potting is not limited to resin but may be other materials. FIGS. 9-15 illustrate conceptually illustrate steps or processes subsequent to potting in step S4. For clarity of illustration, the potting material applied in step S4 is omitted in FIGS. 9-15.

(6) Placing First Mask (S4)

Figure 9:
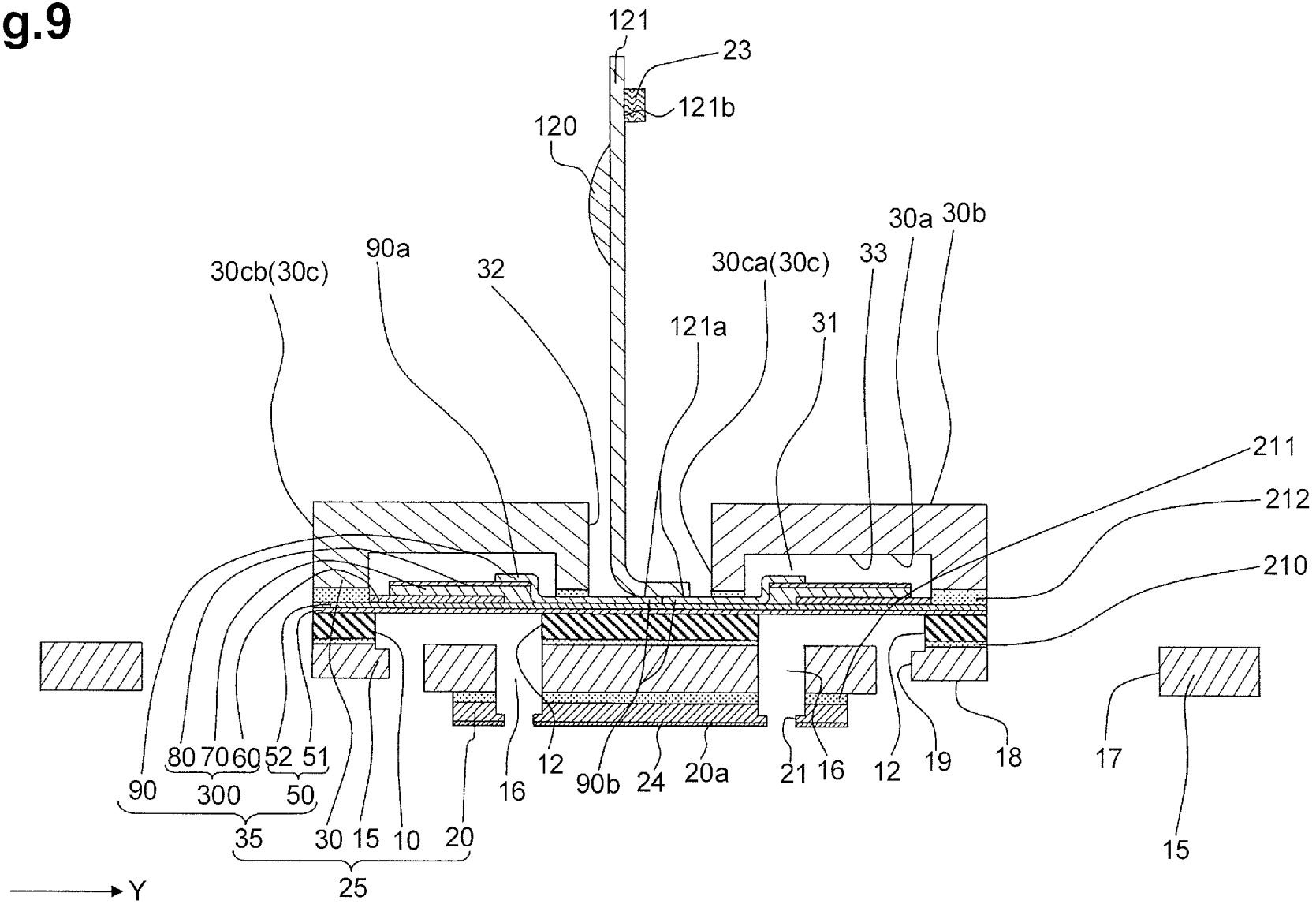
FIG. 9 conceptually illustrates a process of placing a first mask in an illustrative embodiment of the disclosure.

As depicted in FIG. 9, the first mask 23 is disposed on the connecting terminals 121*b* of the wiring substrate 121 having the connecting terminals 121*a* connected with the lead electrodes 90. The first mask 23 may be a silicone resin film, a thermal release film, or a UV release film. Use of the silicone resin film may have an advantage in that the silicone resin film has a high heat resistance. Use of the thermal release film may have an advantage in that a step of removing the first mask may be eliminated by heating the first mask subsequent to the step of forming the protection film 200 by atomic layer deposition (described below). The first mask 23 may have an adhesive layer with a thickness of 15-50 μm. The connecting terminals 121*b* may be masked completely with an adhesive layer whose thickness is within the range. This may effectively prevent or reduce attachment of the protection film 200 to the connecting terminals 121*b* in the step of forming the protection film 200.

(7) Placing Second Mask (S5)

Figure 10:
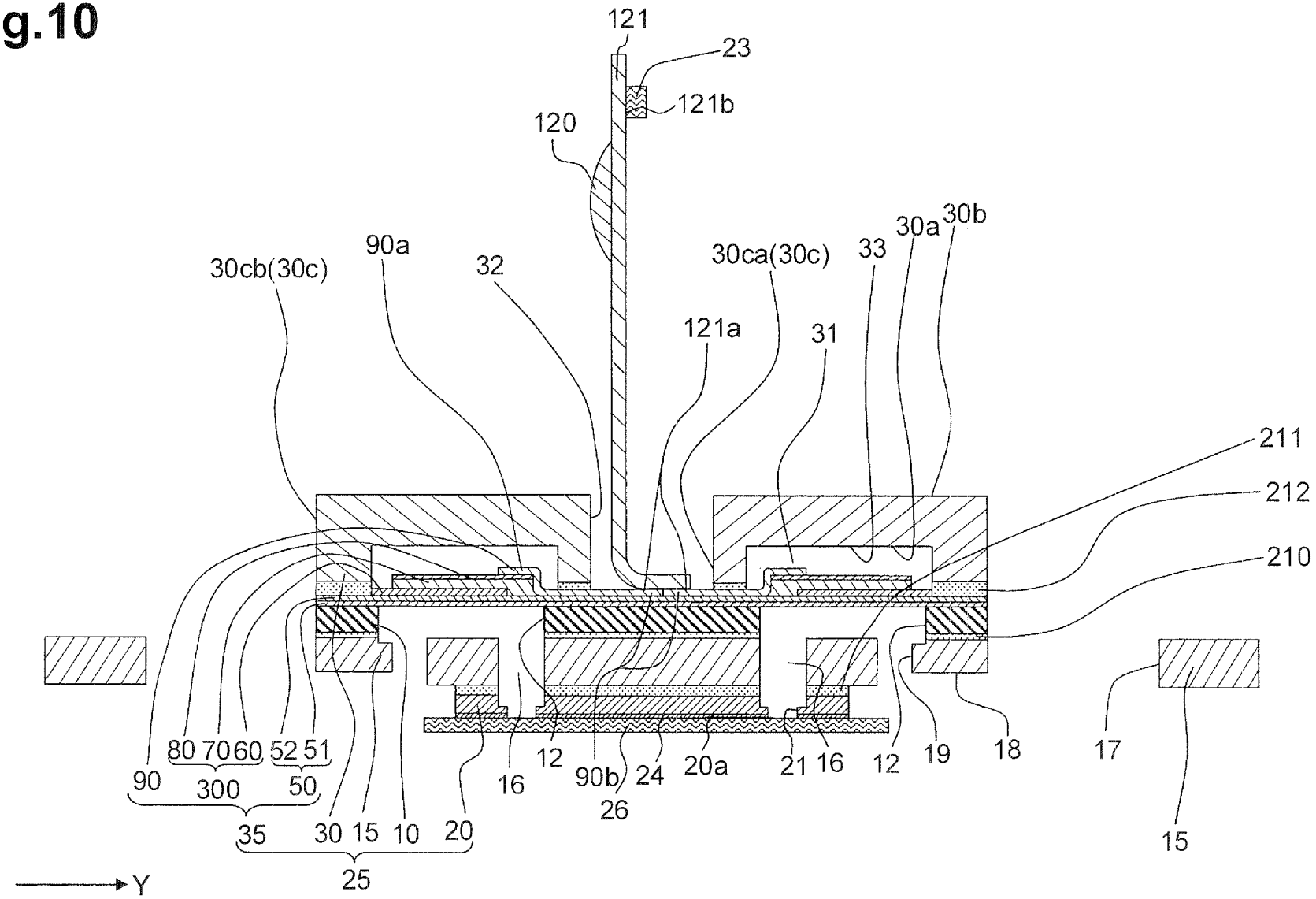
FIG. 10 conceptually illustrates a process of placing a second mask in an illustrative embodiment of the disclosure.

As depicted in FIG. 10, the second mask 26 is placed on the liquid ejection surface 20*a* of the nozzle plate 20 of the laminate 25. The second mask 26 may be a silicone resin film, a thermal release film, or a UV release film. Use of the silicone resin film may have an advantage in that the silicone resin film has a high heat resistance. Use of the thermal release film may have an advantage in that a step of removing the second mask may be eliminated by heating the second mask subsequent to the step of forming the protection film 200 by atomic layer deposition (described below). The second mask 26 may have an adhesive layer with a thickness of 15-50 μm. The liquid ejection surface 20*a* may be masked completely with an adhesive layer whose thickness is within the range. This may effectively prevent or reduce attachment of the protection film 200 to the liquid ejection surface 20*a* or damages on the liquid repellent film 24, in the step of forming the protection film 200. The second mask 26 may not necessarily have openings corresponding to the nozzle openings 21. The nozzle openings 21 may be covered by the second mask 26.

(8) Forming Protection Film (S6)

Figure 11:
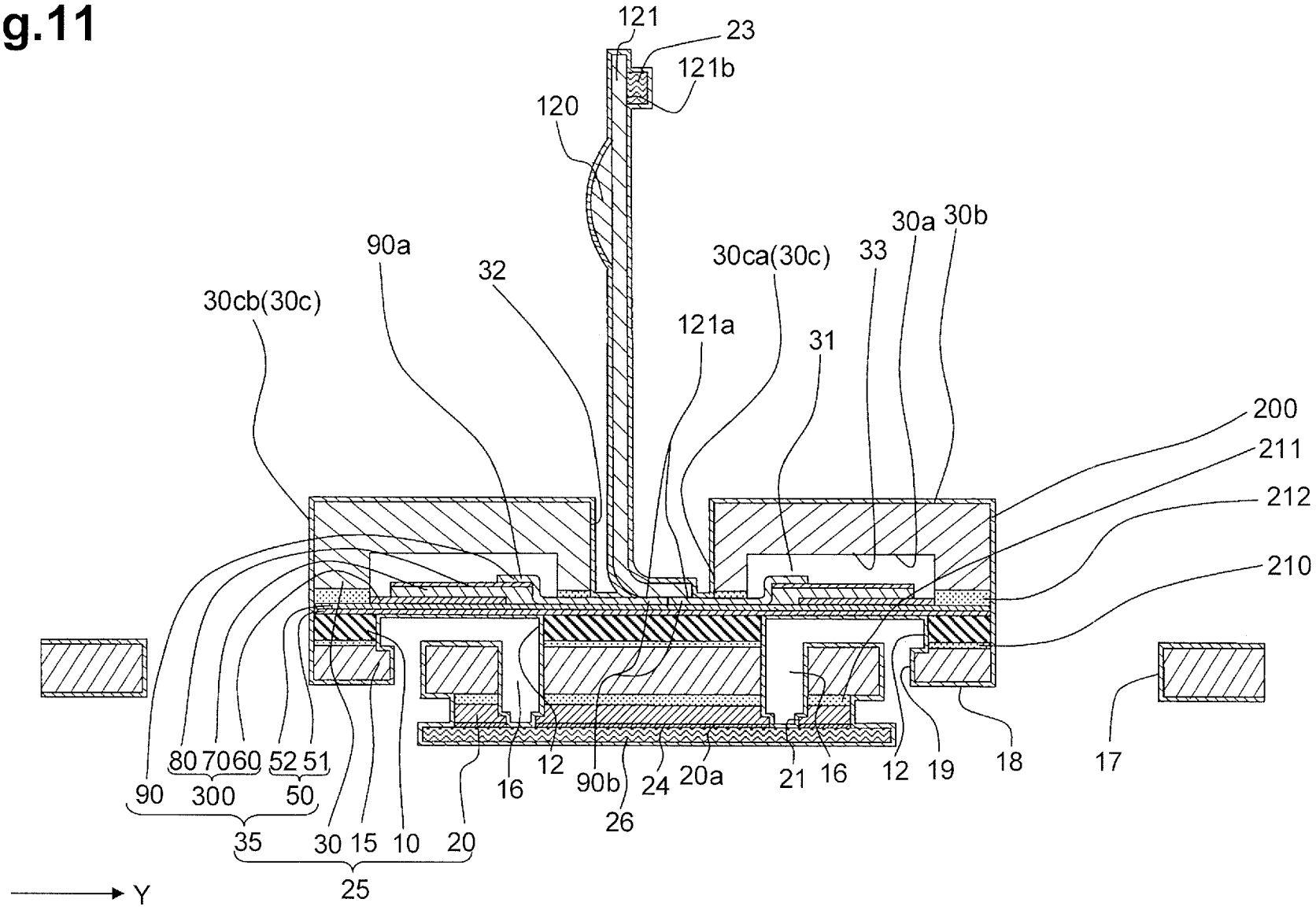
FIG. 11 conceptually illustrates a process of forming a protection film in an illustrative embodiment of the disclosure FIG. 12 conceptually illustrates a process of removing the first mask in an illustrative embodiment of the disclosure.

As depicted in FIG. 11, the protection film 200 is formed, for example, using atomic layer deposition on the laminate 25 to which the wiring substrate 121 has been attached. Surfaces of the laminate 25, the inner walls of the flow paths (e.g., the surfaces defining the flow paths), and surfaces of the wiring substrate 121 are covered or coated with the protection film 200 of the same material. In contrast, in some known processes the protection film may be formed on the lead electrodes before the wiring substrate has been attached to the electrodes. This may result in no electrical contact between the lead electrodes and the wiring substrate.

The protection film 200 is formed using atomic layer deposition (ALD). ALD allows the protection film 200 to completely cover or coat the inner walls of the flow paths, e.g., surfaces defining the manifolds 100, the ink paths 19, the pressure generating chambers 12, the nozzle communication paths 16, and the nozzle openings 21. For example, ALD allows for formation of the protection film 200, with a substantially uniform thickness and with good coverage, on inner walls of narrow portions, such as the nozzle openings 21, the nozzle communication paths 16, and the ink path 19, as well as inner walls of complicated portions, such as the pressure generating chambers 12, the nozzle communication paths 16, and the ink paths 19. A protective film may be formed by methods, such as sputtering and CVD, other than ALD. However, it may be difficult to form, using the methods other than ALD, a protective film with a uniform thickness on a complicated structure that includes, for example, surfaces facing different directions and/or an interior end surface of a narrow portion.

The protection film 200 is formed on surfaces of the adhesives 210-212 exposed to the flow paths. This configuration may prevent or reduce occurrences of problems, such as leakage of ink, ink ejection failure, and separation of substrates or plates, that may be caused by the reduced strengths of the adhesives 210-212 due to etching by liquid, e.g., ink.

The atomic layer deposition method may form a dense protection film 200 having a high film density. The protection film 200 with a high film density may enhance ink resistance (liquid resistance). In other words, while the protection film 200, including at least one material selected from tantalum oxide (TaOx), hafnium oxide (HfOx), aluminum oxide (AlOx) and zirconium oxide (ZrOx), has ink resistance, the protection film 200 formed by the atomic layer deposition, may have an enhanced ink resistance. Such protection film 200 may prevent or reduce etching of the elastic film 51 of the diaphragm 50, the flow channel substrate 10, the communication plate 15, the nozzle plate 20, the protective member 30, and the adhesives 210-212, by liquid, e.g., ink.

The protection film 200 formed by atomic layer deposition has a higher film density than a protection film formed by other methods, for example, CVD. The protective film 200 with a relatively thin film thickness may have sufficient ink resistance. The relatively thin protection film 200 may not impede the deformation of the diaphragm 50, and thus an amount of deformation of the diaphragm 50 may not be reduced.

The protection film 200 may prevent or reduce etching of the diaphragm 50 with ink. This may reduce or minimize variances in properties of the diaphragm 50 and may lead to stable deformation of the diaphragm 50. The protection film 200 formed on the diaphragm 50 may have a generally uniform thickness. This may prevent or reduce variances in deformation of the diaphragm 50, which may be caused by variances in the thickness of the protection film 200.

(9) Removing First Mask (S7)

Figure 12:
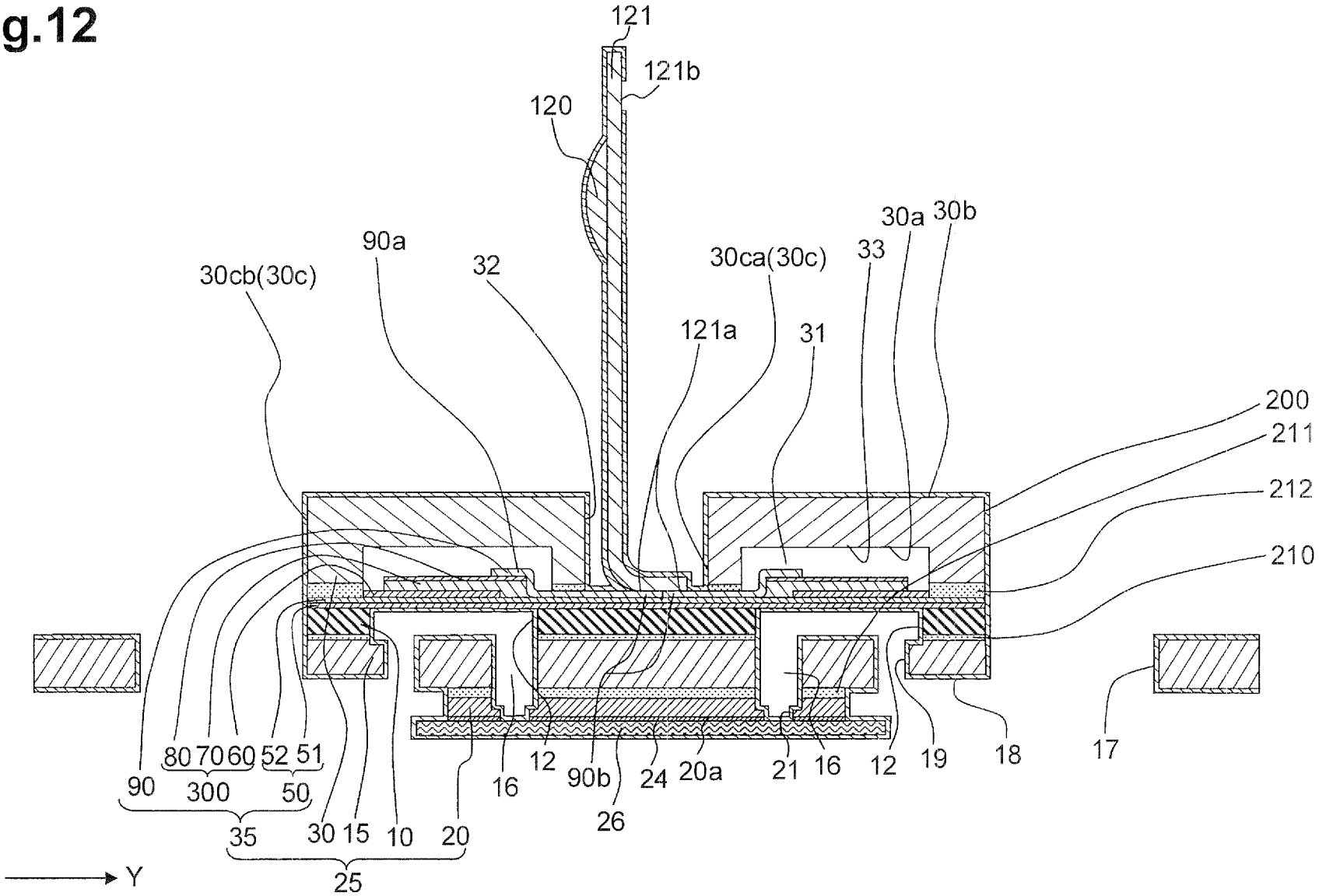

As depicted in FIG. 12, the first mask 23 is removed from the connecting terminals 121*b* of the wiring substrate 121. The first mask 23 may be removed mechanically or with an application of heat or ultraviolet rays. After protection film 200 is removed from the connecting terminals 121*b*, the connecting terminal 121*b* is allowed to connect with an external electronic member.

(10) Removing Second Mask (S8)

Figure 13:
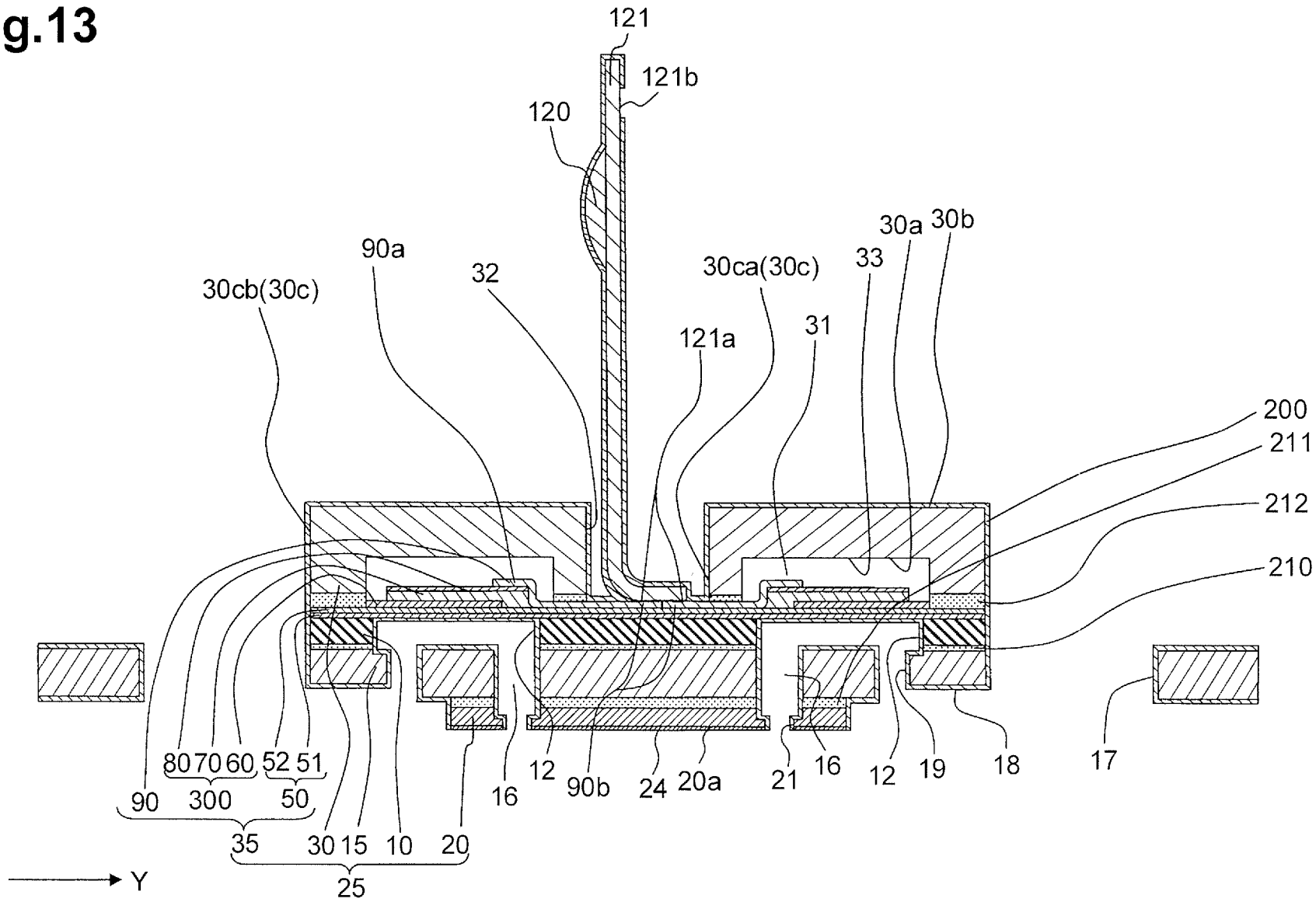
FIG. 13 conceptually illustrates a process of removing the second mask in an illustrative embodiment of the disclosure.

As depicted in FIG. 13, the second mask 26 is removed from the liquid ejection surface 20*a* of the laminate 25. The second mask 26 may be removed mechanically or with an application of heat or ultraviolet rays.

(11) Attaching/Stacking Compliance Substrate (S9)

Figure 14:
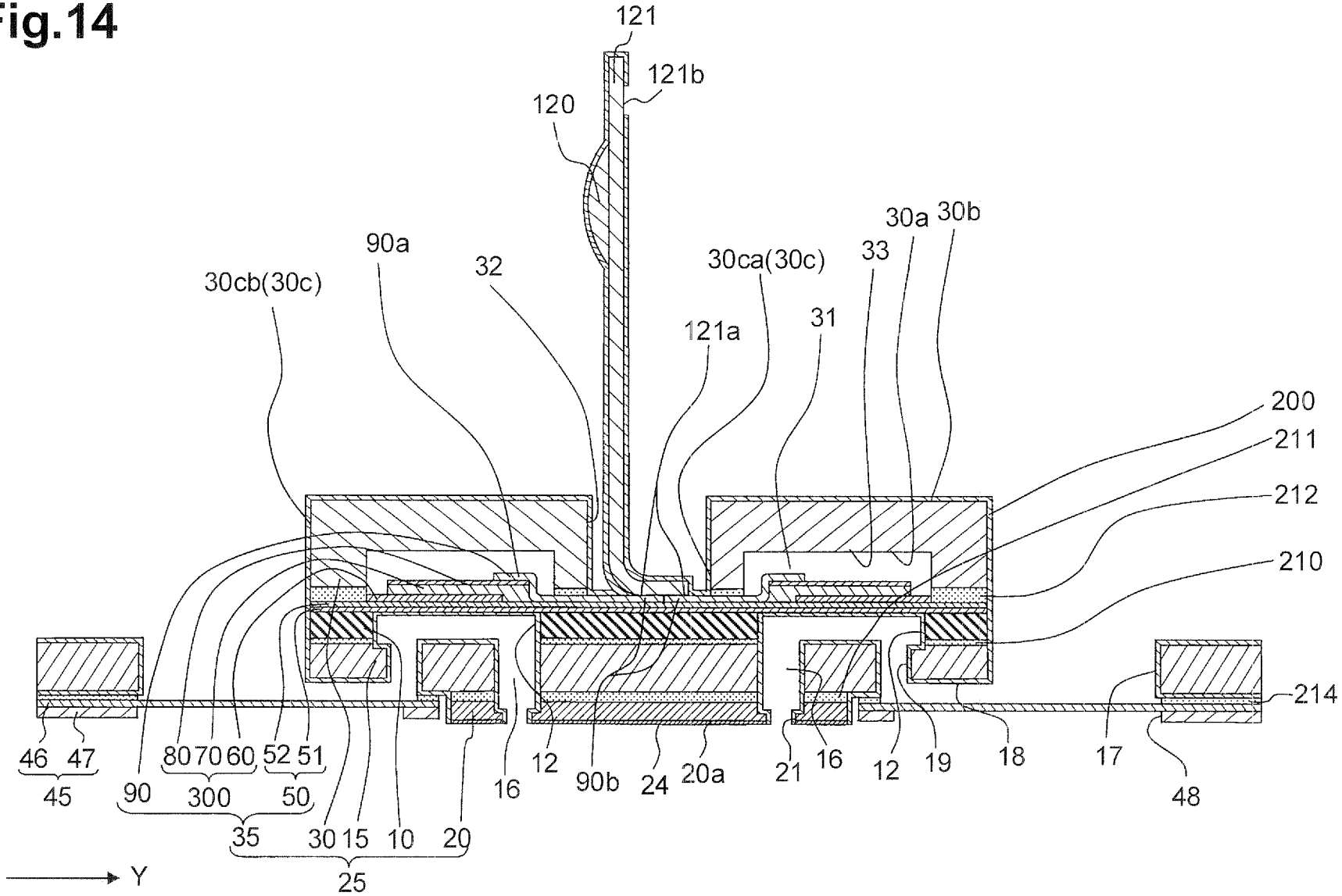
FIG. 14 conceptually illustrates a process of attaching or staking a compliance substrate in an illustrative embodiment of the disclosure.

As depicted in FIG. 14, the compliance substrate 45 is attached to the communication plate 15 with an adhesive 214.

(12) Attaching/Stacking Case Member (S10)

Figure 15:
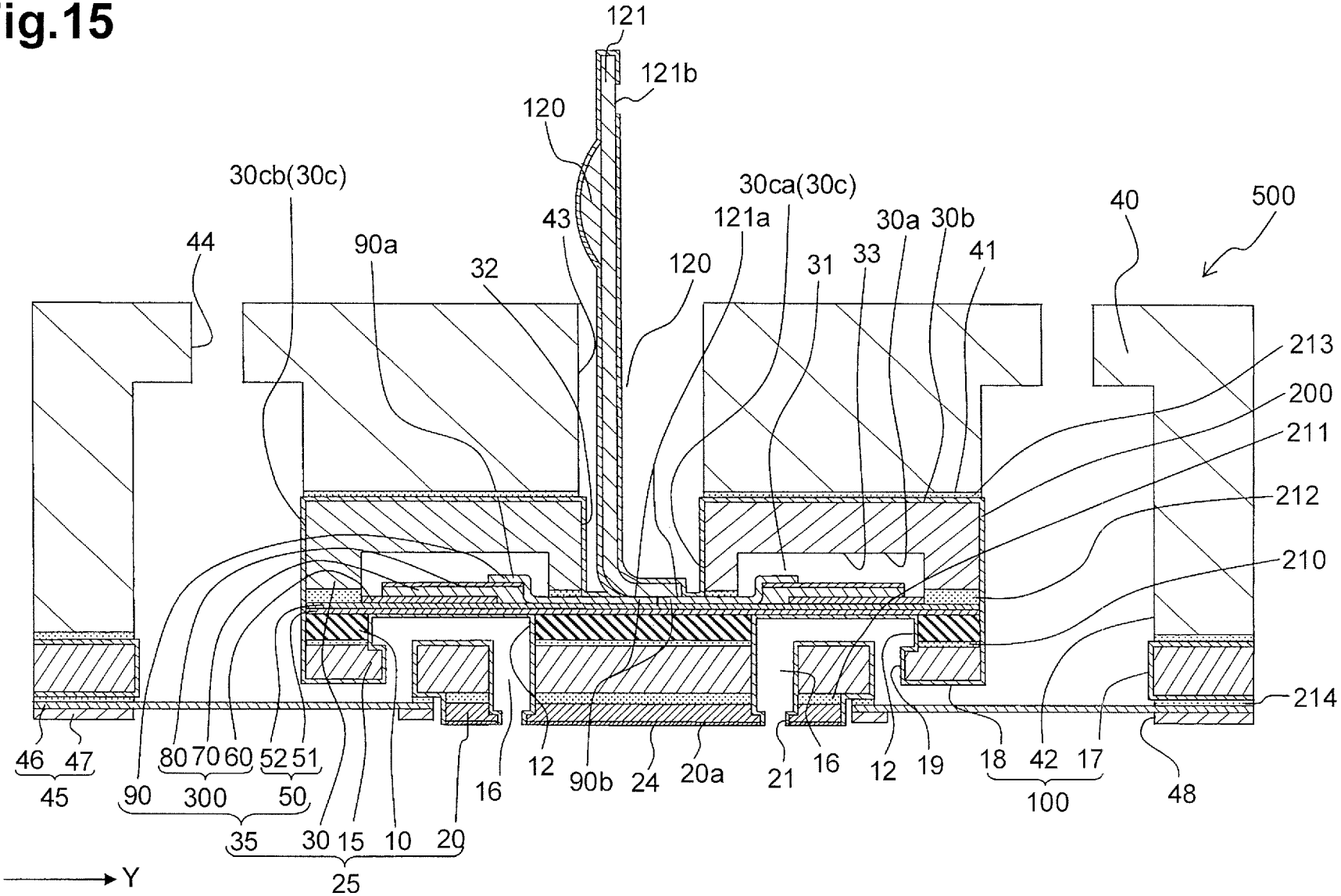
FIG. 15 conceptually illustrates a process of attaching or staking a case member in an illustrative embodiment of the disclosure.

As depicted in FIG. 15, the case member 40 is attached to the communication plate 15 and the protective member 30, via the adhesive 213.

The protection film 200 may be formed by atomic layer deposition after the compliance substrate 45 and/or the case member 40 is attached (e.g., after step S10 or between steps S9 and S10).

The inkjet recording head 500, as depicted in FIGS. 2A and 2B, may thus be manufactured.

The lead electrodes 90 and the wiring substrate 121 may be connected after the protection film 200 is formed, as performed in a known liquid ejecting head. To prevent poor electrical connection between the second connecting terminals 90*b* and the wiring substrate 121 due to attachment of the protection film 200 to the second connecting terminals 90*b*, one of the following two steps or processes may be used: (1) the second connecting terminals 90*b* of the lead electrodes 90 in the slot 32 may be masked (e.g., covered with a mask) before the protection film 200 is formed, or (2) the protection film 200 on the second connecting terminals 90*b* may be removed after the protection film 200 has been formed. In the case (1), it will be difficult to completely cover the second connecting terminals 90*b* with a mask, because the second connecting terminals 90*b* are surrounded by the protective member 30 and are disposed at a lower portion (e.g., a recessed portion) relative to the surrounding of the second connecting terminals 90*b*. In the case (2), the protection film may be removed by, for example, ion milling. However, the protection film on the protective member 30 and the communication plate 15 may also be removed, which may increase the likelihood that the protective member 30 and the communication plate 15 are etched by liquid, e.g., ink. A portion other than the slot 32 may be masked prior to ion milling, to prevent the protection film on the protective member 30 and the communication plate 15 from being removed. However, it will be difficult and take time to place a mask in position on irregular or uneven surfaces caused by, for example, the protective member 30.

In the illustrative embodiment, the protection film 200 is formed after the wiring substrate 121 has been connected to the lead electrodes 90. The liquid ejecting head 500 may be manufactured readily, without covering the second connecting terminals 90*b* of the lead electrodes 90 with a mask before the protection film 200 is formed. The electrical connecting portion, which includes the attachment region and the intersecting portions between the lead electrodes 90 and the surfaces 30*ca* of the protective member 30, is covered by the protection film 200. This may enhance reliability of the electrical connecting portion with respect to humidity resistance.

While the disclosure has been described in detail with reference to the specific embodiment thereof, various changes, arrangements and modifications may be applied therein without departing from the spirit and scope of the disclosure.

For example, the following steps may be optional and omitted: potting portions of the electrodes with resin (S3), placing the first mask (S4), placing the second mask (S5), removing the first mask (S7), removing the second mask (S8), attaching or stacking the compliance substrate (S9), and attaching or stacking the case member (S10). The steps S3, S4, and S5 may be performed at any time prior to the step S6 of forming the protection film, and the order of the steps S3, S4, and S5 may be varied in another embodiment. Similarly, the steps S7, S8, S9, and S10 may be performed at any time subsequent to step S6 of forming a protection film, and the order of the steps S7 through S10 may be varied in another embodiment. In an example in which the step of placing the first mask (S4) is not performed, the protection film 200 on the connecting terminals 121*b* may be removed by polishing.

In the above-described illustrative embodiment, the flow channel substrate 10 and the nozzle plate 20 are attached via the communication plate 15. In another embodiment, for example, the flow channel substrate 10 and the nozzle plate 20 may be directly attached. Alternatively, the flow channel substrate 10 and the nozzle plate 20 are attached via a substrate other than the communication plate 15.

In a case where the case member 40 is made of material that can be etched by liquid, e.g., ink, a protection film formed by ALD may be provided on surfaces of the case member 40 that define the third manifolds 42 and the introduction paths 44, as well as surfaces of the case member 40 that is attached to the laminate 25. This may prevent or reduce etching of the case member 40 by liquid, e.g., ink.

In the illustrative embodiment, a thin-film piezoelectric actuator is used as a pressure generating unit to eject an ink droplet through the nozzle opening 21. In another embodiment, for example, a thick-film piezoelectric actuator, which is formed by, for example, attaching piezoelectric green sheets, or a vertical-vibration piezoelectric actuator, which is formed by alternately laminating a piezoelectric material and an electrode forming material to expand and contract in a vertical direction perpendicular to the direction in which the materials are laminated. In another embodiment, an actuator including a heating element as a pressure generating unit, may be used. The heating element may be disposed within a pressure generating chamber. A liquid droplet is ejected through a nozzle opening due to bubbles generated or formed by the heating of the heating element. Alternatively, an electrostatic actuator may be used in which electrostatic force is generated between a diaphragm and an electrode to deform the diaphragm and thereby to cause a liquid droplet to be ejected through a nozzle opening.

In the illustrative embodiment, the rectangular protective member 30 having the slot 32 is used. In another embodiment, a protective member having no through hole or slot may be used. For example, two rectangular protective members whose longitudinal direction corresponds to the first direction X may be arranged in the second direction Y. In this configuration, the second connecting terminals 90*b* of the lead electrodes 90, which are to be connected to the wiring substrate 121, may be disposed between the two protective members. In another embodiment, for example, one protective member having no through hole or slot may cover all piezoelectric elements of the recording head. In this configuration, the second connecting terminals 90*b* of the lead electrodes 90, which are to be connected to the wiring substrate 121, may be disposed outside the protective member.

<Liquid Ejecting Apparatus>

Figure 16:
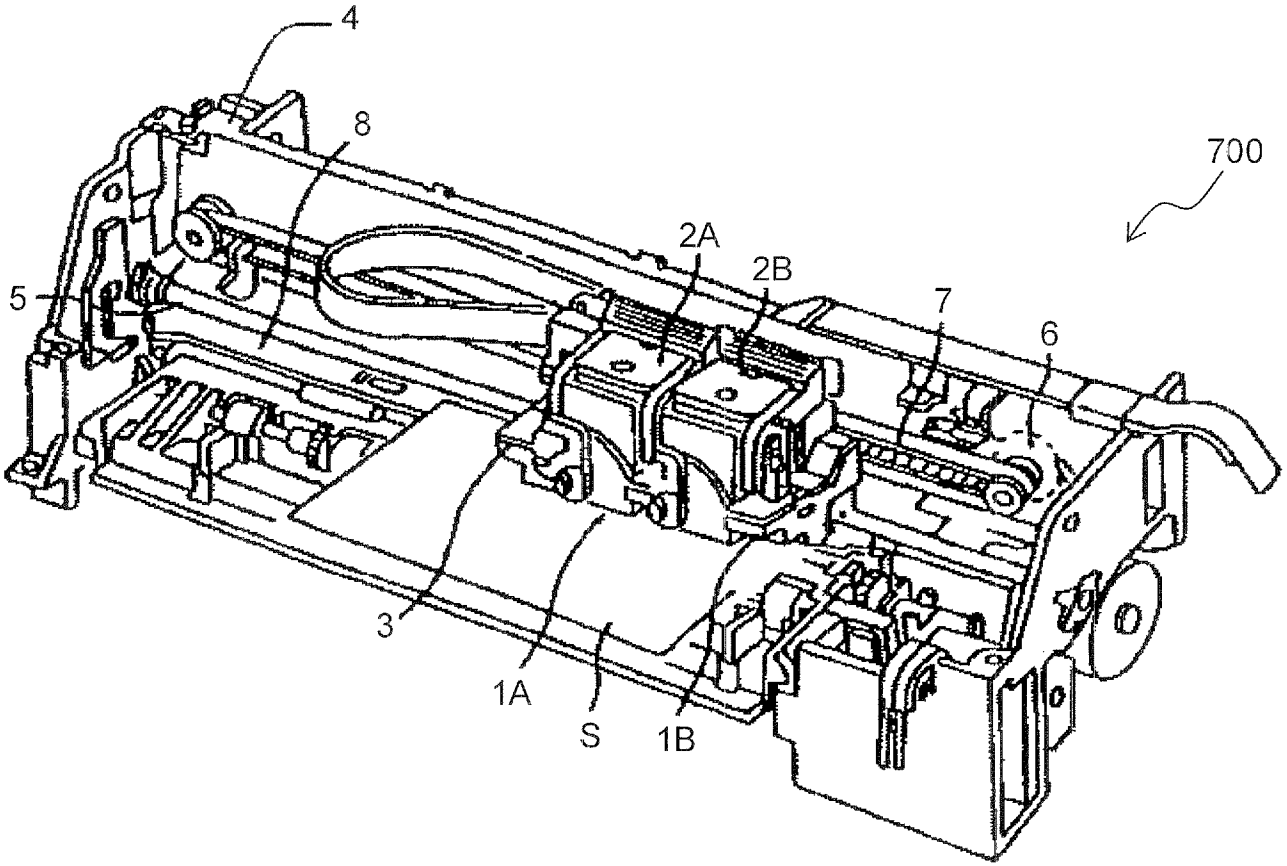
FIG. 16 is a perspective view of a recording apparatus in an illustrative embodiment of the disclosure.

A liquid ejecting apparatus, e.g., an inkjet recording apparatus 700, that includes the inkjet recording heads 500, will now be described referring to FIG. 16. FIG. 16 schematically illustrates an example of the inkjet recording apparatus 700.

The inkjet recording apparatus 700, as depicted in FIG. 16, includes a main casing 4, a carriage shaft 5 attached to the main casing 4, a carriage 3 configured to move in an axial direction of the carriage shaft 5, inkjet recording head units 1A and 1B (hereinafter, simply referred to as the "recording head units 1A and 1B") mounted on the carriage 3, a drive motor 6 configured to generate drive force for moving the carriage 3, a timing belt 7, a platen 8 configured to convey a recording medium, e.g., a recording sheet S, and a feed roller (not depicted) configured to feed the recording sheet S. The recording sheet S may include, but is not limited to a sheet of paper.

Each of the recording head units 1A and 1B includes a plurality of the inkjet recording heads 500. Ink supplies, e.g., cartridges 2A and 2B, are removably attached to the recording head units 1A and 1B, respectively. In one example, the recording head unit 1A is configured to eject black composite ink while the recording head unit 1B is configured to eject color composite ink. The recording head units 1A and 1B have ink flow paths communicating with the respective cartridges 2A and 2B.

The drive force generated by the drive motor 6 is transmitted to the carriage 3, via a plurality of gears (not depicted) and the timing belt 7, thereby causing the carriage 3 to move along the carriage shaft 5. The platen 8 is disposed in the main casing 4 and extends along the carriage shaft 5. The recording sheet S is conveyed over the platen 8.

In the inkjet recording apparatus 700, the inkjet recording heads 500 (the recording head units 1A and 1B) mounted on the carriage 3, move in a main scanning direction. In another embodiment, for example, the inkjet recording heads 500 may be fixed at prescribed positions and may print an image onto a recording sheet S that is moved in a sub scanning direction perpendicular to the main scanning direction. In other words, the liquid ejecting heads according to the illustrative embodiment may be applied to, what is called, a "line recording apparatus".

In the example of the inkjet recording apparatus 700 as described above, liquid supplies, e.g., the cartridges 2A and 2B, are mounted on the carriage 3. In another embodiment, liquid supplies, e.g., ink tanks, may be fixed to the main casing 4 and may be connected to the recording heads 500 via supply conduits, e.g., tubes. Further, the liquid supplies may not necessarily be mounted on the inkjet recording apparatus 700.

The inkjet recording head 500 is described as an example of a liquid ejecting head, and the inkjet recording apparatus 700 is described as an example of a liquid ejecting apparatus. Aspects of the disclosure may be applied to liquid ejecting heads configured to eject liquid other than ink. Examples of liquid ejecting heads may include recording heads used in image recording apparatuses such as printers; color material ejecting heads used for manufacturing color filters of, for example, liquid crystal displays; electrode material ejecting heads used for forming electrodes of, for example, organic EL displays and field emission displays ("FEDs"); and bio-organic material ejecting heads used for manufacturing bio-chips.

What is claimed is:

1. A liquid ejection head comprising;

a laminate including an electrode, the laminate defining a nozzle and a flow path configured to provide liquid communication to the nozzle;

a wiring substrate having a first terminal connected to the electrode; and a protection film on a surface of the laminate and an outside surface of the wiring substrate.

2. The liquid ejection head according to claim 1, further comprising a potting compound covering the electrode and the first terminal.

3. The liquid ejection head according to claim 2, wherein the protection film covers at least a portion of the potting compound.

4. The liquid ejection head according to claim 2, wherein the protection film is formed after the potting compound is applied.

5. The liquid ejection head according to claim 1;
wherein the protection film includes at least one material selected from tantalum oxide (TaOx), hafnium oxide (HfOx), aluminum oxide (AlOx) or zirconium oxide (ZrOx).

6. The liquid ejection head according to claim 1;
wherein the protection film is not formed on the first terminal of the wiring substrate and the electrode at a location where the first terminal is connected to the electrode.

7. The liquid ejection head according to claim 1;
wherein the laminate includes:
a diaphragm including an upper surface;
a piezoelectric element on the upper surface of the diaphragm; and
a protective member attached to the upper surface of the diaphragm and positioned over the piezoelectric element on the diaphragm;
wherein the electrode have a first portion and a second portion, wherein the second portion contacts the upper surface of the diaphragm and is connected to the first terminal of the wiring substrate,
wherein the protective member includes;
a lower surface facing the diaphragm;
an upper surface opposite to the lower surface;
first and second side surfaces spaced apart from one another and extending between the lower surface and the upper surface;
wherein a recess is formed by the lower surface of the protective member between the first and second side surfaces,
wherein the piezoelectric element is disposed in the recess of the protective member,
wherein the first portion of the electrode connects the piezoelectric element in the recess,
wherein the first side surface of the protective member is located between the first and second portions of the electrode.

8. The liquid ejection head according to claim 7;
wherein the protection film is formed on the first side surface of the protective member.

9. The liquid ejection head according to claim 7;
wherein the protection film is formed on the upper surface of the protective member.

10. The liquid ejection head according to claim 7;
wherein the protective member is connected to the diaphragm via an adhesive layer,
wherein the adhesive layer includes;
an upper surface contacting the protective member;
a lower surface contacting the diaphragm;
a first side surface extending between the upper surface and the lower surface, the first side surface exposed to the recess,
a second side surface opposite to the first surface and extending between the upper surface and the lower surface,
wherein the diaphragm includes;
a lower surface opposite to the upper surface of the diaphragm;
a side surface extending between the upper surface and the lower surface of the diaphragm; and
wherein the protection film is formed on the second surface of the protective member, the second side surface of the adhesive layer and the side surface of the diaphragm.

11. The liquid ejection head according to claim 1;
wherein the wiring substrate includes a drive circuit; and
wherein the protection film is formed on a surface of the drive circuit.

12. The liquid ejection head according to claim 1;
wherein the wiring substrate is a chip on film (COP), a flexible cable (FFC), or a flexible printed circuit (FPC).

* * * * *